US007529509B2

(12) United States Patent
Ito et al.

(10) Patent No.: US 7,529,509 B2
(45) Date of Patent: May 5, 2009

(54) DEVELOPMENT DEVICE WITH DISPENSER CHAMBER INSIDE BULKHEAD, AND PROCESS CARTRIDGE AND IMAGE FORMING APPARATUS USING THE DEVICE

(75) Inventors: Isao Ito, Kanagawa (JP); Takeshi Okoshi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/245,224

(22) Filed: Oct. 7, 2005

(65) Prior Publication Data

US 2006/0222412 A1 Oct. 5, 2006

(30) Foreign Application Priority Data

Mar. 29, 2005 (JP) ..... P2005-096084

(51) Int. Cl.
*G03G 15/08* (2006.01)

(52) U.S. Cl. ..... 399/258

(58) Field of Classification Search ..... 399/258
See application file for complete search history.

(56) References Cited

U.S. PATENT DOCUMENTS

| | | | | |
|---|---|---|---|---|
| 4,982,238 A | | 1/1991 | Davidson | |
| 5,172,168 A | | 12/1992 | Satoh et al. | |
| 5,434,656 A | * | 7/1995 | Nagaoka et al. | 399/106 |
| 5,617,192 A | | 4/1997 | Tonomoto et al. | |
| 5,943,537 A | | 8/1999 | Ahn | |
| 6,597,882 B1 | * | 7/2003 | Tanaka | 399/258 |
| 2006/0216067 A1 | * | 9/2006 | Okoshi | 399/258 |

FOREIGN PATENT DOCUMENTS

| | | | |
|---|---|---|---|
| JP | 59-061850 | A | 4/1984 |
| JP | 10-142916 | A | 5/1998 |
| JP | 10-239970 | A | 9/1998 |
| JP | 11-44997 | A | 2/1999 |
| JP | 2001-305861 | A | 11/2001 |

OTHER PUBLICATIONS

Machine translation of JP 11-044997 A and JP 10-239970 A.*

* cited by examiner

*Primary Examiner*—David M Gray
*Assistant Examiner*—Ruth N Labombard
(74) *Attorney, Agent, or Firm*—Sughrue Mion, PLLC

(57) ABSTRACT

A developing device includes: a developing unit having a developer storage chamber for storing a developer composed of a toner and a carrier, in which a developer agitating carrying member and a developer holding member capable of holding and carrying the developer agitated and carried by the developer agitating carrying member are disposed in the developer storage chamber; and an auxiliary developing unit for supplementing development for the developing unit, wherein: the developer storage chamber of the developing unit and the auxiliary storage chamber of the auxiliary developing unit are disposed adjacently via a bulkhead; a dispenser chamber that can supply or withdraw a fixed amount of developer is formed in communication with the developer storage chamber and the auxiliary storage chamber inside the bulkhead; and a dispenser member for carrying a fixed amount of developer is disposed within the dispenser chamber.

16 Claims, 25 Drawing Sheets

DEVELOPMENT DEVICE WITH DISPENSER CHAMBER INSIDE BULKHEAD, AND PROCESS CARTRIDGE AND IMAGE FORMING APPARATUS USING THE DEVICE

BACKGROUND OF THE INVENTION

1. Field of the Invention

The present invention relates to a developing device usable for an image forming apparatus such as an electrophotographic copying machine or a printer, and more particularly to improvements in a developing device, a process cartridge using this developing device, and an image forming apparatus, in which the developing device comprises a developing unit for developing an electrostatic latent image on an image carrier into a visual image, and an auxiliary developing unit connected in communication with the developing unit to supplement the development for the developing unit.

2. Background Art

The conventional image forming apparatus of electrophotographic method normally adopts a system in which an electrostatic latent image formed on an image carrier such as a photosensitive drum is developed with the toner by a developing device (into a visible image), and a toner image is transferred onto a transfer medium such as the paper or an intermediate transfer member by a transfer device, while the residual toner on the image carrier is withdrawn by a cleaning device.

And the developing device 500 has a developing unit 510 for developing the image with a developer composed of a toner and a carrier, and additionally a developer refill unit 520 for refilling the developer with the consumption of developer used in the developing unit 510 to extend the life of this developing unit 510 as shown in FIG. 24 or 25 has already been offered (refer to JP-A-2001-305861, JP-A-10-239970 and JP-A-11-44997).

In the conventional developing device of this type as described in JP-A-2001-305861, the developing unit 510 has a development housing 511 opposed to an image carrier 501 such as a photosensitive drum, in which a developer storage chamber 512 for storing the developer G composed of the toner and the carrier is provided within the development housing 511, a developing roll 513 is disposed in a portion facing an opening of the developing housing 511, and the agitating carrying augers 514 and 515 for agitating and carrying the developer G are disposed within the developer storage chamber 512, as shown in FIG. 24.

On the other hand, the developer refill unit 520 has a refill container 521 for storing the developer G composed of the toner and the carrier, in which the refill container 521 and the development housing 511 are communicated through a communication duct 522 to refill the developer G within the refill container 521 into the developer storage chamber 512 by causing the developer G to fall due to its dead load onto the developer G stored within the developer storage chamber 512.

In FIG. 24, the developer refill unit 520 has a withdrawal container 530 that can withdraw the developer G deteriorated in the developer storage chamber 512, in which the withdrawal container 530 and the development housing 511 are communicated through a communication duct 531.

Also, in the developing device as described in JP-A-10-239970 and JP-A-11-44997, the developing unit 510 is substantially the same as described in JP-A-2001-305861, except that the developer refill unit 520 has a refill housing 541 with a part of the development housing 511 for the developing unit 510 as a housing bulkhead 550, a developer refill chamber 542 storing the refill developer is provided within this refill housing 541, an agitator 543 for agitating and carrying the developer is disposed within the developer refill chamber 542, and a developer refill mechanism and a developer withdrawal mechanism are provided on the side of the developing unit 510 in the developer refill chamber 542, as shown in FIG. 25A.

Herein, the developer refill mechanism is provided with a developer refill passage 545 on a passage bulkhead 544, in which a refill auger 546 is disposed within the developer refill passage 545, and a supply port 547 is opened in the housing bulkhead 550, as shown in FIGS. 25A and 25B. This supply port 547 is provided above the axial center of an agitating carrying auger 515, preferably above the surface position of the developer in a portion where the agitating carrying auger 515 is disposed, to supply the developer smoothly without being subjected to a pressure of the developer G from the developer storage chamber 512.

On the other hand, the developer withdrawal mechanism is provided with a developer withdrawal passage 555 on the passage bulkhead 554, in which a withdrawal auger 556 is disposed within the developer withdrawal passage 555, and a withdrawal port 557 is opened in the housing bulkhead 550, as shown in FIG. 25C. This withdrawal port 557 is provided below the axial center of the agitating carrying auger 515 to increase the ability of withdrawing the developer from the developer storage chamber 512.

However, in the developing device (having the developer refill unit 520) as described in JP-A-2001-305861, because of a structure in which the developing unit 510 and the developer refill unit 520 are communicated through the connection duct 522, the apparatus constitution is enlarged only by a set space of the connection duct 522, and it is difficult to meet the demand of miniaturization easily.

In this respect, in the developing device as described in JP-A-10-239970 and JP-A-11-44997, the developing unit 510 and the developer refill unit 520 are adjacently disposed via the housing bulkhead 550, and the developer refill mechanism or the developer withdrawal mechanism is disposed in the portion along the housing bulkhead 550 in the developer refill chamber 542, whereby it may be possible to attempt the miniaturization of the developing device.

However, since the developing device as described in JP-A-10-239970 and JP-A-11-44997 adopts a structure in which the developer refill passage 545 or the developer withdrawal passage 556 is secured in a part of the area within the developer refill chamber 542, and the refill auger 546 and the withdrawal auger 556 are disposed in the passages 545 and 555, there is an anxiety of obstructing the transportation of the developer as the capacity space of the developer refill chamber 542 is not only uselessly invaded but also the area to which no transportation power by the agitator 543 is exerted occurs in the developer refill chamber 542.

Such a technical problem also arises even if the auxiliary developing units such as the refill unit for refilling only the toner or carrier and the withdrawal unit for withdrawing the deteriorated developer are provided.

SUMMARY OF THE INVENTION

This invention has been achieved to solve the above-mentioned technical problem, and it is an object of the invention to provide a developing device having an auxiliary developing unit for supplementing the development for a developing unit, in which an internal capacity space is secured while meeting the demand for miniaturizing the apparatus, and the transportability of the developer is kept excellent to supply or withdraw a fixed amount of developer, and a process cartridge using the developing device, and an image forming apparatus.

According to the invention, there is provided a developing device including: a developing unit having a developer storage chamber for storing a developer composed of a toner and a carrier, in which a developer agitating carrying member and a developer holding member capable of holding and carrying the developer agitated and carried by the developer agitating carrying member are disposed in the developer storage chamber; and an auxiliary developing unit for supplementing development for the developing unit, the auxiliary developing unit connected in communication with the developing unit and having an auxiliary storage chamber for storing the developer containing at least one of the toner and the carrier, wherein:

the developer storage chamber of the developing unit and the auxiliary storage chamber of the auxiliary developing unit are disposed adjacently via a bulkhead; a dispenser chamber that can supply or withdraw a fixed amount of developer is formed in communication with the developer storage chamber and the auxiliary storage chamber inside the bulkhead; and a dispenser member for carrying a fixed amount of developer is disposed within the dispenser chamber.

With the developing device of the invention, since the developer storage chamber of the developing unit and the auxiliary storage chamber of the auxiliary developing unit are disposed adjacently via the bulkhead, the dispenser chamber that can supply or withdraw a fixed amount of developer in communication to the developer storage chamber and the auxiliary storage chamber, is formed inside the bulkhead, and the dispenser member for carrying a fixed amount is disposed in this dispenser chamber, it is unnecessary that a partial space for disposing the dispenser mechanism is secured in the auxiliary storage chamber of the auxiliary developing unit, effectively avoiding a risk that the space is wasteful or there is an adverse influence on the developer carrying ability, and contributing to miniaturization of the apparatus.

Also, with a process cartridge or an image forming apparatus using the developing device, the process cartridge or the image forming apparatus capable of supplying or withdrawing a fixed amount of developer can be simply constructed, while the developing device is miniaturized.

BRIEF DESCRIPTION OF THE DRAWINGS

These and other objects and advantages of this invention will become more fully apparent from the following detailed description taken with the accompanying drawings in which.

Figure 1A:
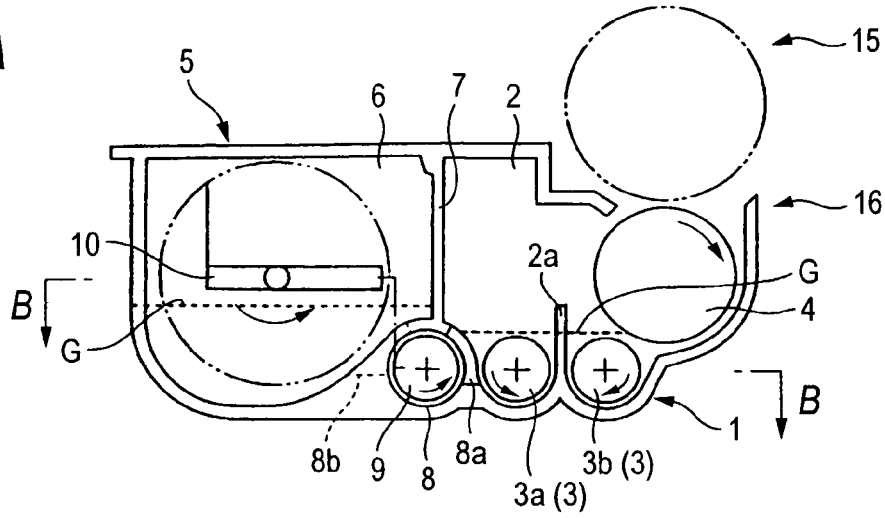
FIG. 1A is an explanatory view showing a developing device, a process cartridge using the developing device, and an image forming apparatus according to the present invention.
Figure 1B:
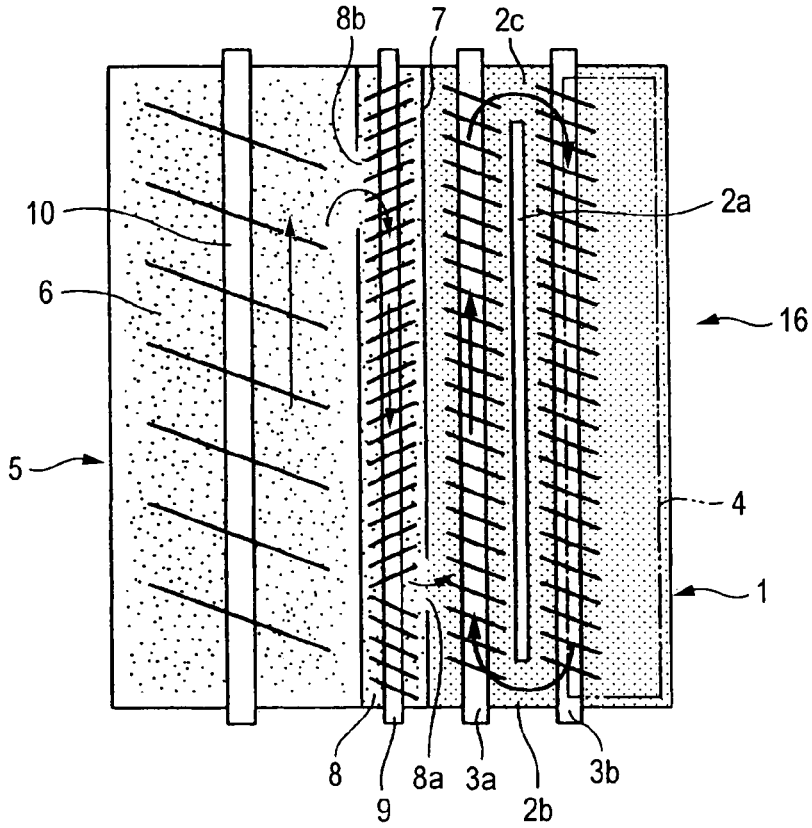
FIG. 1B is a cross-sectional explanatory view taken along the line B-B in FIG. 1A.

DETAILED DESCRIPTION OF THE PREFERRED EMBODIMENTS the present invention provides a developing device including a developing unit 1 having a developer storage chamber 2 for storing a developer G composed of a toner and a carrier, in which a developer agitating carrying member 3 and a developer holding member capable of holding and carrying the developer G agitated and carried by the developer agitating carrying member 3 are disposed in the developer storage chamber 2, and an auxiliary developing unit 5 for supplementing development for the developing unit 1, the auxiliary developing unit 5 connected in communication with the developing unit 1 and having an auxiliary storage chamber 6 for storing the developer G containing at least one of the toner and the carrier, characterized in that the developer storage chamber 2 of the developing unit 1 and the auxiliary storage chamber 6 of the auxiliary developing unit 5 are disposed adjacently via a bulkhead 7, a dispenser chamber 8 that can supply or withdraw a fixed amount of developer is formed in communication with the developer storage chamber 2 and the auxiliary storage chamber 6 inside the bulkhead 7, and a dispenser member 9 for carrying a fixed amount of developer is disposed within the dispenser chamber 8, as shown in FIGS. 1A and 1B.

In the technical means, the invention is on the premise that the developing unit 1 and the auxiliary developing unit 5 are disposed adjacently via the bulkhead 7.

It is only necessary that the developing unit 1 comprises the developer storage chamber 2, the developer agitating carrying member (auger) 3 and the developer holding member 4, and other functional members (a supply member to the developer holding member 4 and a layer forming member) may be provided, as needed.

Herein, the developer G stored in the developer storage chamber 2 is two component developer composed of the toner and the carrier. In a preferred form of the developer storage chamber 2 of this type, the developer storage chamber 2 is divided into two by the partition wall 2*a* extending along the axial direction of the developer holding member 4, in which the communication ports 2*b* and 2*c* are opened at both ends of this partition wall 2*a* in the longitudinal direction to constitute a developer circulation path in the developer storage chamber 2, and one pair of developer agitating carrying members 3 (3*a*, 3*b*) are disposed in the developer circulation path.

Also, the auxiliary developing unit 5 is broadly intended to supplement the development for the developing unit 1, and may be appropriately employed for the supply of the developer, the withdrawal of the developer, or the supply and withdrawal of the developer.

Herein, for the supply of the developer, the auxiliary storage chamber 6 stores beforehand a new developer containing at least one of the toner and the carrier, and a fixed amount of developer is supplied from the auxiliary storage chamber 6 via the dispenser chamber 8. A typical form is a toner refill unit (storing the refill toner in principle, or storing the developer at least containing the refill toner in consideration of a so-called trickle method (refilling the developer itself and withdrawing the deteriorated developer as the waste), or a carrier refill unit for supplying the carrier alone.

On the other hand, for the withdrawal of the developer, a fixed amount of used developer is withdrawn from the developer storage chamber 2 via the dispenser chamber 8 and stored in the auxiliary storage chamber 6. A typical form is the developer withdrawal unit for withdrawing the used developer. This developer withdrawal unit may be provided separately from the developer supply unit, but may be employed commonly.

Moreover, it is necessary that the auxiliary developing unit 5 comprises the auxiliary storage chamber 6 for storing at least one of the toner and the carrier. Though the developer carrying member 10 such as agitator is usually disposed in this auxiliary storage chamber 6, the developer carrying member 10 may not be provided, because the developer can be supplied owing to its dead load. Also, the auxiliary developing unit 5 may consist of a single unit or multiple units.

Also, the developer storage chamber 2 of the developing unit 1 and the auxiliary storage chamber 6 of the auxiliary developing unit 5 are disposed adjacently via the bulkhead 7, although the thickness or the shape of the bulkhead 7 is appropriately selected. In a typical form for securing the dispenser chamber 8 inside the bulkhead 7, the bulkhead has a thin wall portion for partitioning the developer storage chamber 2 and the auxiliary storage chamber 6, in which a thick wall portion is provided in a part of the thin wall portion, and the dispenser chamber 8 is formed within the thick wall portion.

Herein, the dispenser chamber 8 can supply or withdraw a fixed amount of developer, and usually has a long passage structure of the same cross-section.

Moreover, the dispenser member 9 can carry a fixed amount of within the dispenser chamber 8, and typically takes an auger construction.

Moreover, the dispenser chamber 8 communicates to the developer storage chamber 2 and the auxiliary storage chamber 6 via the communication ports 8*a* and 8*b*, although the size, the disposed position and the number of the communication ports 8*a* and 8*b* can be appropriately selected.

In a preferred communication structure between the dispenser chamber 8 and the developer storage chamber 2, a communication port 8*a* between both is opened so that its lower end may be located below a surface position of the developer G stored within the developer storage chamber 2. In this way, at least part of the communication port 8*a* between both is buried under the surface position of the developer G within the developer storage chamber 2, whereby the refill toner can be securely mixed with the developer by supplying the refill toner to the developer within the developer storage chamber 2 from the side.

Also, the dispenser chamber 8 is preferably provided along a longitudinal direction of the bulkhead 7. In this case, the developer carrying length of the dispenser member 9 can be secured, whereby the dispensing performance (fixed amount supply ability, fixed amount withdrawal ability) is stabilized while the space is saved.

Particularly, the dispenser chamber 8 is preferably provided over the almost entire area in the longitudinal direction of the bulkhead 7. In this form, the developer carrying length of the dispenser member 9 is maximized in the limited space.

Moreover, in a preferred communication structure of the dispenser chamber 8, a communication port 8*b* to the auxiliary storage chamber 6 and a communication port 8*a* to the developer storage chamber 2 are spaced apart. The developer carrying length of the dispenser member 9 is effectively secured.

In a preferred form of the dispenser mechanism, the thin wall portion of the bulkhead 7 is provided around an axially central position of the dispenser member 9 within the dispenser chamber 8. In this form, since the almost equal space is invaded in the developer storage chamber 2 and the auxiliary storage chamber 6 by the dispenser mechanism, there is no adverse influence on the developer carrying ability in each of the storage chambers 2 and 6 with the disposition of the dispenser mechanism.

Moreover, the dispenser chamber 8 may be provided at any position, but is preferably provided on a lower portion of the bulkhead 7. In this case, the developer can be supplied or withdrawn from the auxiliary storage chamber 6 or the developer storage chamber 2 to the dispenser mechanism without being lifted, whereby the ability of supplying or withdrawing the developer to the dispenser mechanism is stabilized.

Moreover, when the auxiliary developing unit 5 is configured for the supply of the developer, a developer carrying member 10 is preferably provided in the auxiliary storage chamber 6, in which the central position of the developer carrying member 10 is located above the position of the communication port 8*b* between the auxiliary storage chamber 6 and the dispenser chamber 8. In this form, since it is unnecessary to lift the developer from the auxiliary storage chamber 6 to the dispenser chamber 8, the developer is refilled smoothly into the developer storage chamber 2 without hampering the internal pressure of developer within the dispenser chamber 8.

Also, in a preferred outside form of the bulkhead 7, the developer carrying member 10 is provided in the auxiliary storage chamber 6, in which a part of the bulkhead 7 on the side of the auxiliary storage chamber 6 on a wall outside face surrounding the dispenser chamber 8 is formed along a rotation locus of the developer carrying member 10. In this case, the developer carrying ability from the auxiliary storage chamber 6 is kept excellent.

Moreover, a part of the bulkhead 7 on the side of the developer storage chamber 2 on a wall outside face surrounding the dispenser chamber 8 is formed along a rotation locus of the developer agitating carrying member 3 (specifically 3*a*). In this case, the developer carrying ability in the developer storage chamber 2 is kept excellent.

Also, each of the communication ports 8*a* and 8*b* to the dispenser chamber 8 is preferably covered with a seal member that is closed openably when in use. In this form, the dispenser chamber 8 is hermetically sealed with the seal member, whereby the developer is filled in the dispenser chamber 8 during the transportation with less risk of causing a blinding.

The invention is not limited to the above developing device, but may be applicable to the process cartridge or the image forming apparatus as described below.

That is, the invention provides a process cartridge removably mounted on a main body of an image forming apparatus, comprising an image carrier 15 and the developing device 16, opposed to the image carrier 15, for developing the electrostatic latent image on the image carrier 15 into the visible image, as shown in FIG. 1A.

Moreover, the invention provides an image forming apparatus comprising the image carrier 15 and the developing device 16, opposed to the image carrier 15, for developing the electrostatic latent image on the image carrier 15 into the visible image. The developing device 16 may or may not comprise the process cartridge.

The preferred embodiments of the present invention will be described below in detail with reference to the accompanying drawings.

Embodiment 1

Overall Constitution of Image Forming Apparatus

Figure 2:
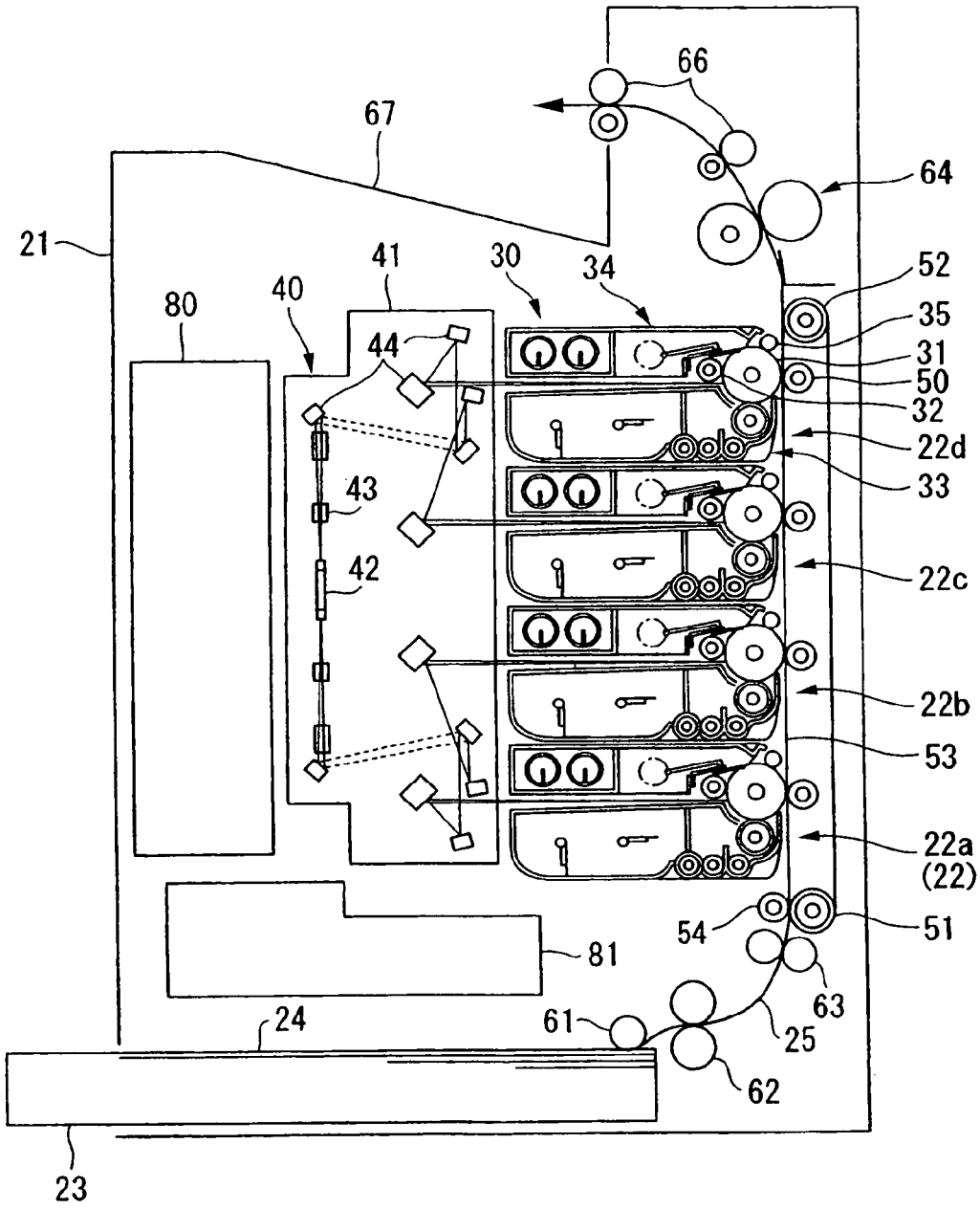
FIG. 2 is an explanatory view showing the image forming apparatus according to an embodiment 1 of the invention.

FIG. 2 is a view showing an image forming apparatus according to an embodiment 1 of the invention.

In FIG. 2, the image forming apparatus is a so-called tandem-type color image forming apparatus, in which the image forming units 22 (specifically 22*a* to 22*d*) of four colors (yellow, magenta, cyan and black in this embodiment) are arranged longitudinally within an apparatus housing 21, a sheet feed cassette 23 for storing the sheets 24 to be supplied is disposed under them, and a sheet conveying path 25 that is a conveying path of the sheet 24 from the sheet feed cassette 23 is disposed vertically in a portion corresponding to each image forming unit 22.

In this embodiment, each of the image forming units 22 (22*a* to 22*d*), forming the toner images of yellow, magenta, cyan and black in order from the upstream side of the sheet conveying path 25, comprises a process cartridge 30 incorporating various kinds of process units and an exposing device 40 for exposing the process cartridge 30 to a scanning light for making the image.

Herein, the process cartridge 30 comprises integrally, as a cartridge, a photosensitive drum 31, a charging roll 32 for charging in advance the photosensitive drum 31, a developing device 33 for developing an electrostatic latent image exposed on the charged photosensitive drum 31 by the exposing device 40, with a corresponding color toner (e.g., at negative polarity in this embodiment), a cleaning device 34 for removing the waste toner on the photosensitive drum 31, and an erase lamp 35 for erasing the charges on the surface of the charged photosensitive drum 31.

On the other hand, the exposing device 40 comprises, within a case 41, a semiconductor laser, not shown, a polygon mirror 42, an image forming lens 43 and a mirror 44, in which the light from the semiconductor laser is deflected and scanned so that an optical image is led via the image forming lens 43 and the mirror 44 to an exposing point on the photosensitive drum 31.

Moreover, in this embodiment, a conveying belt 53 that circularly moves along a sheet conveying path 25 is disposed in a portion corresponding to the photosensitive drum 31 of each image forming unit 22.

This conveying belt 53 is made of a belt material (rubber or resin) that can electrostatically adsorb the sheet 24, and looped around a pair of stretching roll 51, 52, in which an upper stretching roll 52 is a driving roll and a lower stretching roll 51 is a follower roll in this embodiment.

Moreover, a sheet adsorbing roll 54 is disposed at an entrance portion (opposed to the stretching roll 51) of the conveying belt 53, whereby the sheet 24 is adsorbed to the conveying belt 53 by applying a high adsorbing voltage to the sheet adsorbing roll 54. Also, a transfer roll 50 is disposed on the back side of the conveying belt 53 corresponding to the photosensitive drum 31 of each image forming unit 22, and puts the sheet 24 on the conveying belt 53 into close contact with the photosensitive drum 31 by this transfer roll 50. And a predetermined transfer bias from a transfer bias power source is appropriately applied between the transfer roll 50 and the photosensitive drum 31.

In this embodiment, a pickup roll 61 for delivering the sheet 24 at a predetermined timing is provided near the sheet feed cassette 23, whereby the sheet is fed via a conveying roll 62 and a registration roll 63 to a transfer position.

Moreover, a fixing device 64 is provided on the sheet conveying path 25 located on the downstream side of the most downstream image forming unit 22*d*, and a sheet exhausting roll 66 for exhausting the sheet is provided on the downstream side of the fixing device 64, whereby the sheet is exhausted into a sheet receiving tray 67 formed on the top of the apparatus housing 21.

In FIG. 2, reference numeral 80 denotes a high voltage power source for supplying a high voltage to the high voltage devices, and 81 denotes a low voltage power source for supplying a low voltage to the low voltage devices.

An image making process of the image forming apparatus is as follows.

As shown in FIG. 2, in each image forming unit 22 (22*a* to 22*d*), the photosensitive drum 31 is charged by the charging roll 32. After a latent image is formed on the photosensitive drum 31 by the exposing device 40, a visible image (toner image) is formed by the developing device 33.

On the other hand, the sheet 24 from the sheet teed cassette 23 is delivered at a predetermined timing by the pickup roll 61, and fed via the conveying roll 62 and the registration roll 63 to an adsorbing position on the conveying belt 53, and then into the transfer position while being adsorbed to the conveying belt 53.

And a toner image on the photosensitive drum 31 of each image forming unit 22 is transferred onto the sheet 24 by the transfer roll 50, the unfixed toner image of each color component on the sheet 24 is fixed by the fixing device 64, and the sheet 24 after fixing is exhausted into the receiving tray 67.

Outline of Process Cartridge

Figure 3:
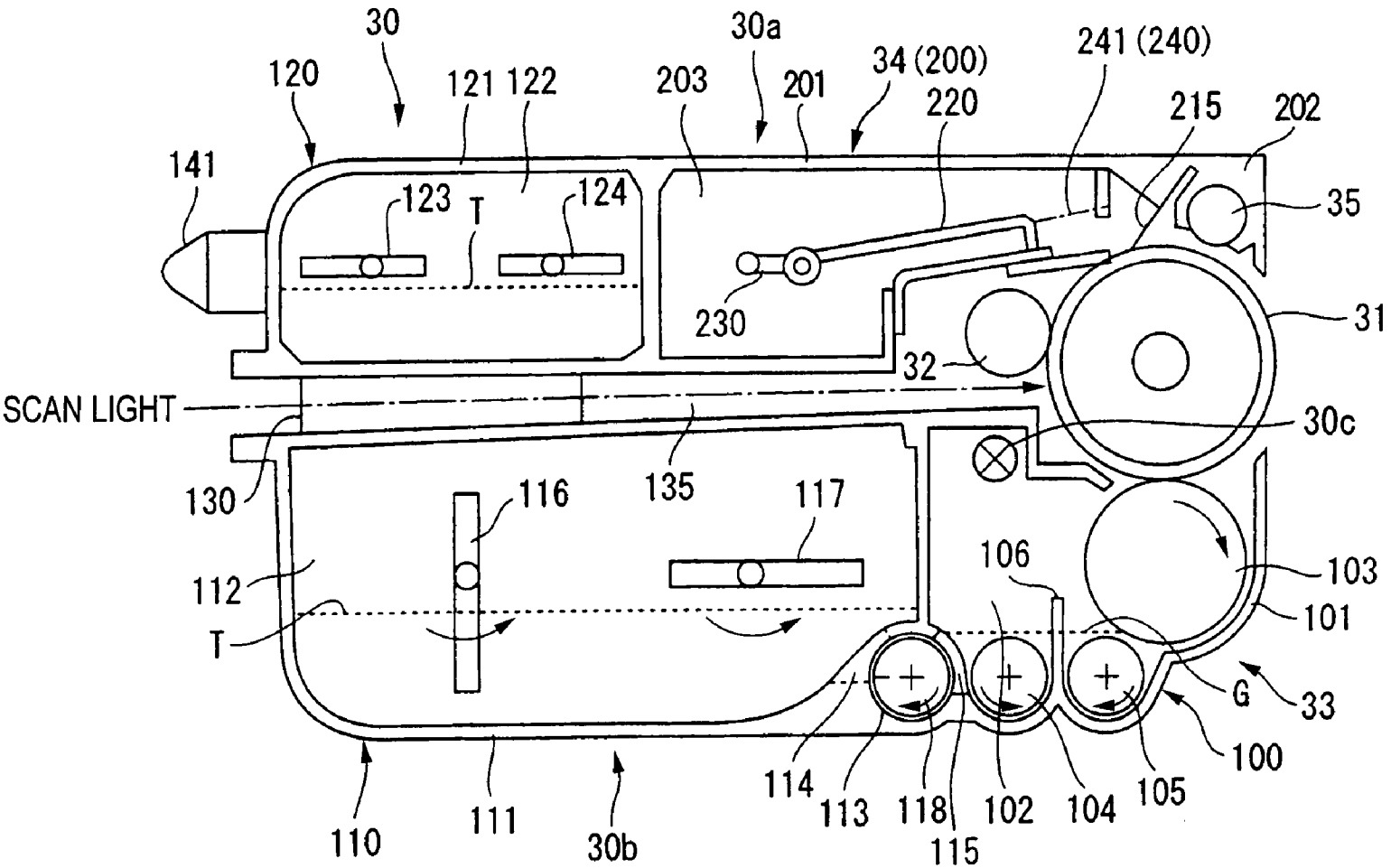
FIG. 3 is an explanatory view showing in detail the process cartridge for use in this embodiment.

FIG. 3 shows the details of the process cartridge 30 according to this embodiment.

In FIG. 3, the process cartridge 30 is composed of a photosensitive cartridge 30*a* having the photosensitive drum 31, the charging roll 32, a part of the developing device 33, the cleaning device 34, and the erase lamp 35 for erasing the charges on the photosensitive drum 31 before the cleaning process, and a developing cartridge 30*b* located under the photosensitive cartridge 30*a* to be slidable with the photosensitive cartridge 30*a* and, and having a main part of the developing device 33.

Particularly, in the embodiment, the developing device 33 comprises a developing unit 100, opposed to the photosensitive drum 31, for developing the electrostatic latent image on the photosensitive drum 31 into the visible image with the developer G composed of the toner and the carrier, and the toner refill units 110 and 120 (a separation type in which a main toner refill unit 110 and a sub toner refill unit 120 are separately provided in this embodiment) for refilling the toner T in the developing unit 100.

And the photosensitive cartridge 30*a* comprises a cleaning unit 200, or the cleaning device 34 as a unit, and a sub toner refill unit 120, which are integrated in the transverse direction, and the developing cartridge 30*b* comprises the developing unit 100 and a main toner refill unit 110, which are integrated in the transverse direction.

Moreover, in this embodiment, the developing cartridge 30*b* is provided pivotably around a pivot shaft 30*c* in a portion of the developing unit 100 while the photosensitive cartridge 30*a* is securely positioned in the apparatus housing 21, a scanning passage 135 to pass a scanning light from the exposing device 40 is secured between the photosensitive cartridge 30*a* and the developing cartridge 30*b*, and a spacer 130 made of an elastic material is interposed on either side of each parts cartridge 30*a*, 30*b* near the entrance of this scanning passage 135, so that the developing cartridge 30*b* is pressed and urged onto the photosensitive cartridge 30*a*. Instead of or in addition to the spacer 130, a biasing element such as a biasing spring may be employed.

Figure 4A:
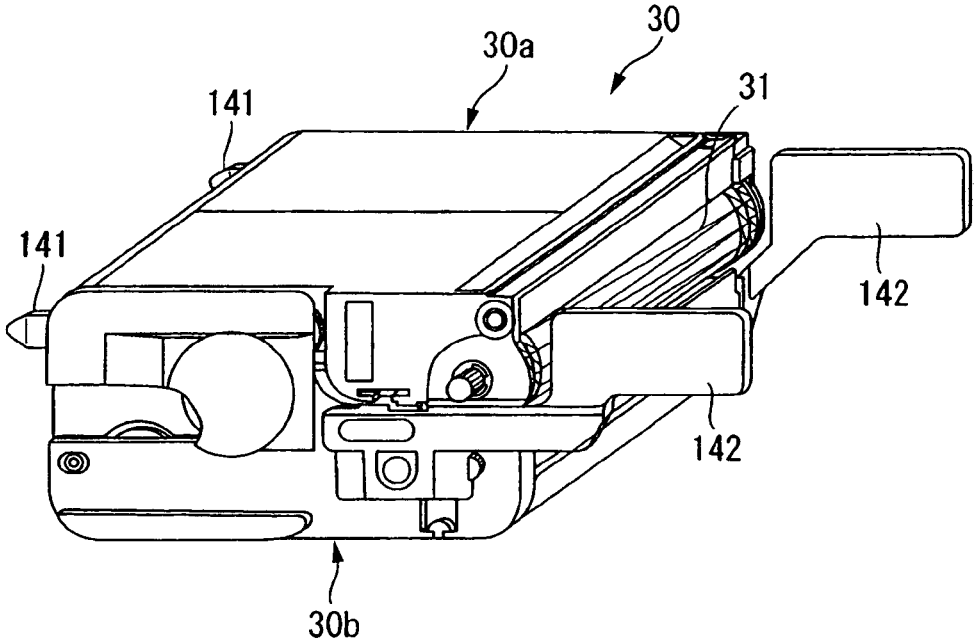
FIG. 4A is a perspective view of the process cartridge for use in this embodiment, as seen from one side.
Figure 4B:
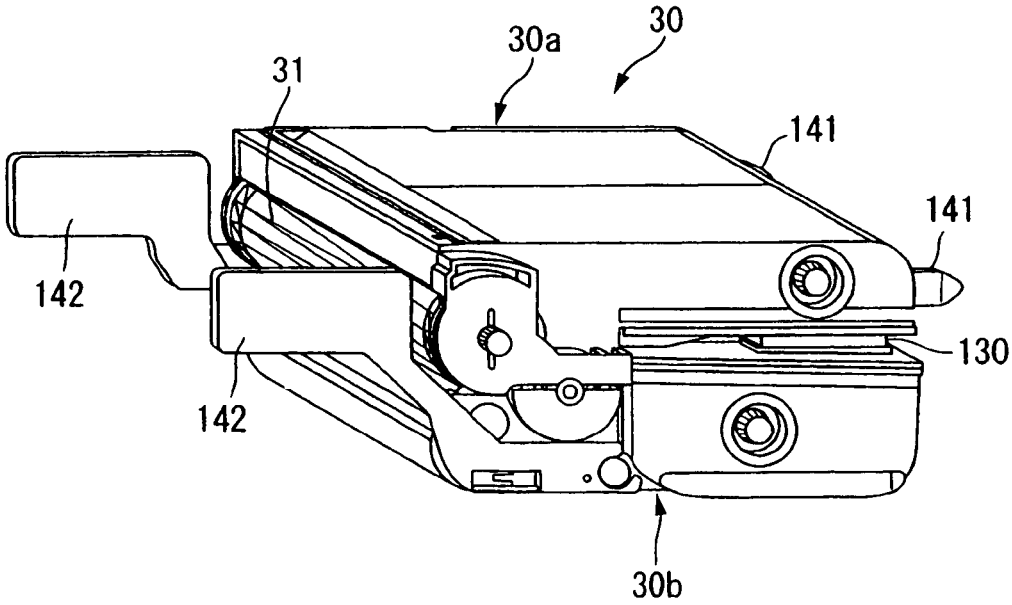
FIG. 4B is a perspective view of the process cartridge for use in this embodiment, as seen from the opposite side.

Also, in this embodiment, the sub toner refill unit 120 of the photosensitive cartridge 30*a* is provided with one pair of supporting projections 141 extending in a direction orthogonal to the axial direction of the photosensitive drum 31, as shown in FIG. 3 and FIGS. 4A and 4B.

And when the process cartridge 30 is mounted in a cartridge receiving portion (not shown) of the apparatus housing 21, both ends of a support shaft rotatably supporting the photosensitive drum 31 are secured at the predetermined positioned by a securing and receiving member, not shown, provided in the cartridge receiving portion, and a drive transmission member (e.g., drive transmission gear) disposed at one end of the photosensitive drum 31 disposed rotatably around the support shaft is linked and engaged with a driving system, not shown, provided in the cartridge receiving portion. Also, one pair of supporting projections 141 engage the engaged portions (concave portions or bores) in the cartridge receiving portion, so that the photosensitive cartridge 30*a* is positioned and secured in the apparatus housing 21. Herein, it is necessary that the cartridge receiving portion of the apparatus housing 21 can receive and hold the process cartridge 30. The cartridge receiving portion may be constructed by employing a housing frame itself, or providing another member for the housing frame.

Particularly, in this embodiment, the supporting projections 141 are provided on a unit outer wall away from the photosensitive drum 31, and have a function of suppressing the rotation of the process cartridge 30 due to a driving force for driving the photosensitive drum 31.

In FIG. 4, reference numeral 142 denotes a grasping arm used when mounting or dismounting the process cartridge 30.

Developing Device

Each of the units 100, 110 and 120 making up the developing device 33 for use in this embodiment will be described below.

Developing Unit

Figure 5:
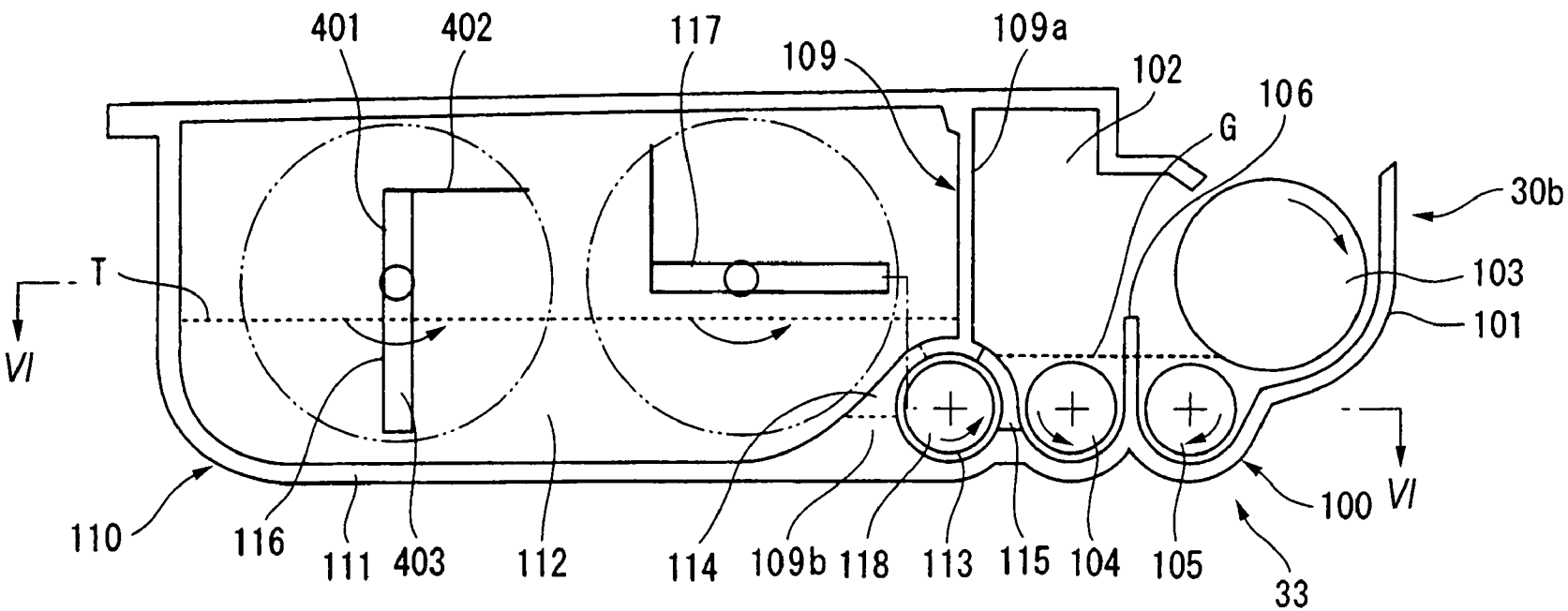
FIG. 5 is an explanatory view showing a developing cartridge for use in this embodiment.
Figure 6:
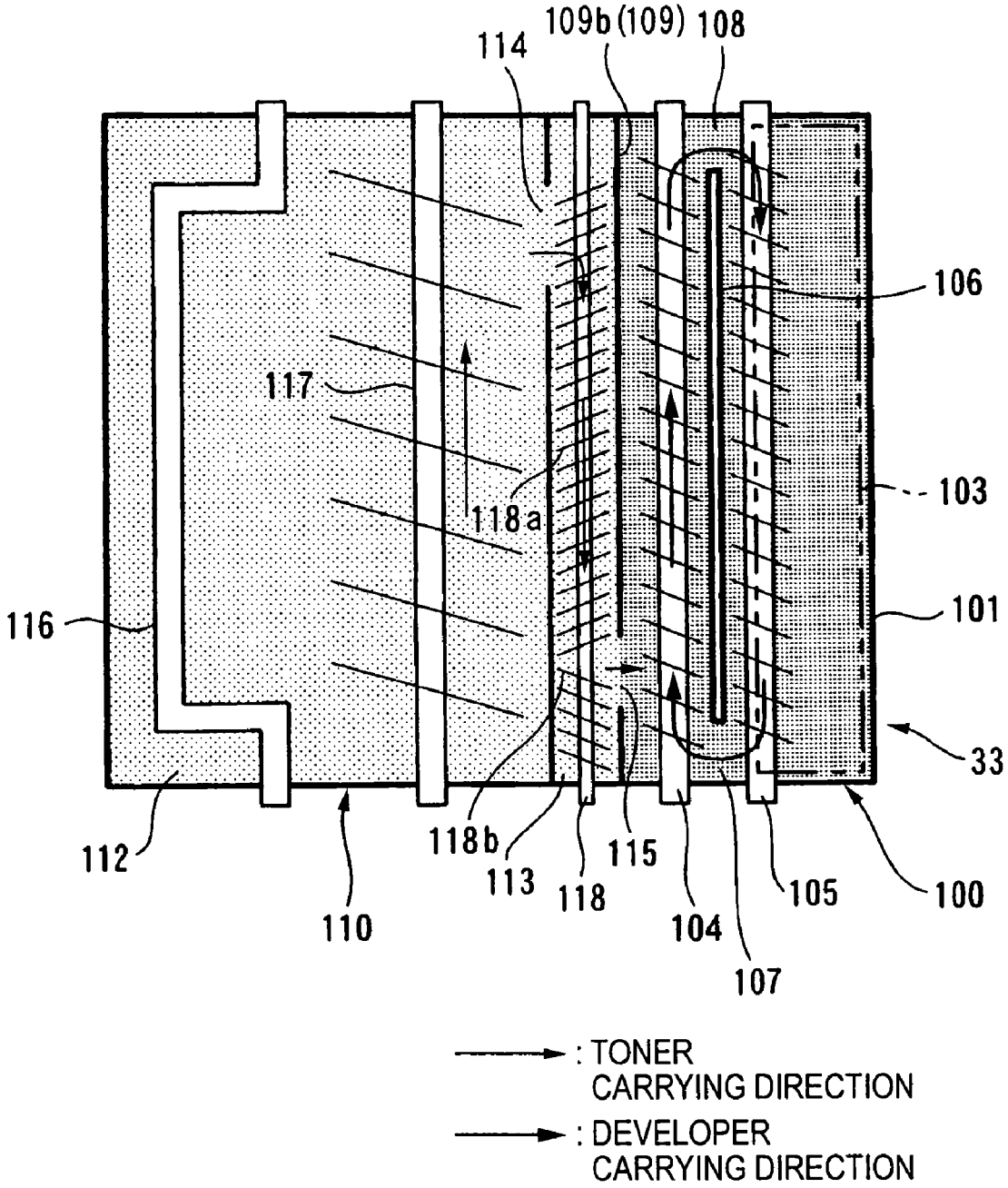
FIG. 6 is an explanatory view, partially broken away, taken along the line VI-VI in FIG. 5.

In this embodiment, the developing unit 100 adopts a so-called two component development system, and has a development housing 101 opened to the photosensitive drum 31 on the lower side of the photosensitive drum 31, the inside of the development housing 101 being configured as a developer storage chamber 102 capable of storing the developer G composed of the toner and the carrier, and a developing roll 103 for holding the developer is disposed in a portion facing an opening of the development housing 101, as shown in FIGS. 3, 5 and 6. And in this developing unit 100, the developer storage chamber 102 is divided into two by a partition wall 106 extending along the axial direction of the developing roll 103, and the communication ports 107 and 108 are opened at both ends of the partition wall 106 in the longitudinal direction to make a developer circulation path in the developer storage chamber 102, in which one pair of agitating carrying augers 104 and 105 are disposed along the axial direction of the developing roll 103 on this developer circulation path to carry the developer G on the developer circulation path while agitating it.

Herein, an agitating carrying auger 104 is an admixing auger principally aimed at agitating and mixing the toner T specifically replenished to the existent developer G, while an agitating carrying auger 105 is a supply auger having a developer supply function to the developing roll 103 in addition to the agitating and mixing function of the toner.

Though in this embodiment, the agitating carrying auger 105 near the developing roll 103 also has the developer supply function to the developing roll 103, a developer supply member (roll or paddle) may be added separately from the agitating carrying auger 105. Also, a trimming member for regulating the layer thickness of developer or a withdrawal member for withdrawing the unused developer may be provided around the developing roll 103, as needed.

Main Toner Refill Unit

The main toner refill unit 110 has a main refill housing 111 partially serving as a rear bulkhead 109 of the development housing 101 in the developing unit 100, and is configured as a toner refill chamber for storing the refill toner T to be refilled within the main refill housing 111, as shown in FIGS. 3, 5 and 6.

Particularly, in this embodiment, the toner refill chamber is divided into a toner storage chamber 112 for storing the refill toner T and a dispenser chamber 113 communicating to the toner refill chamber 112 and quantitatively refilling the toner T to the developing unit 100. Herein, the rear bulkhead 109 of the developing housing 101 has a thin wall portion 109*a*, and a thick wall portion 109*b* like an unfolded fan provided closer to the bottom of the thin wall portion 109*a*. And the dispenser chamber 113 is provided with the thick wall portion 109*b* closer to the bottom of the rear bulkhead 109 for the developing housing 101, and configured as a long passage (tunnel passage), circular in cross section, extending along the axial direction of the developing roll 103 within the thick wall portion 109*b*.

And a dispenser inlet port 114 is opened in a portion facing the toner storage chamber 112 on the rear side of the thick wall portion 109*b* in the longitudinal direction, while a toner supply port 115 is opened in a portion of the thick wall portion 109*b* facing the developer storage chamber 102 on the opposite side of the dispenser inlet port 114 in the longitudinal direction.

Moreover, within the toner storage chamber 112, there are disposed an agitator 116 for agitating and carrying the refill toner T and an agitator 117 for agitating and carrying the toner T agitated and carried by the agitator 116 to the dispenser inlet port 114 of the dispenser chamber 113.

Herein, the agitator 116 has an agitator film 402 made from a PET film at the distal end of a crank-like rotation rod 401 to carry the toner along the wall surface of the toner refill chamber owing to this agitator film 402. And an adequate number of agitation rods 403 extend in the radial direction of the rotation rod 401 on the opposite side of the agitator film 402 in the rotation rod 401 to agitate the toner within the toner refill chamber. Also, the agitator 117 is the same as the agitator 116, but preferably provided with an appropriate slit in the agitator film to adjust the toner carrying direction toward the dispenser inlet port 114. The agitators 116 and 117 may be the agitating carrying augers.

In FIG. 6, the agitators 116 and 117 are schematically shown.

On the other hand, a dispensing auger 118 is disposed longitudinally in the dispenser chamber 113. Particularly, in this embodiment, the dispensing auger 118 has a helical wing having a diameter almost equal to or less than that of the agitating carrying augers 104 and 105 within the developing unit 100. Further, the dispensing auger 118 is set to a pitch or less of the agitating carrying augers 104 and 105.

Moreover, in this embodiment, the thin wall portion 109*a* of the bulkhead 109 is provided around the axial center of the dispensing auger 118 within the dispenser chamber 113, in which a space invaded by a dispense mechanism (dispenser chamber 113, dispensing auger 118) is apportioned almost evenly by the developer storage chamber 102 and the toner storage chamber 112. Therefore, the arrangement of the dispense mechanism has no adverse influence on the developer or toner carrying ability within the storage chamber 102, 112.

Also, a part of the outer side face of the thick wall portion 109*b* surrounding the dispenser chamber 113 on the side of the toner storage chamber 112 is formed substantially along a rotation locus (specifically equivalent to the rotation locus at the top end of the agitator film 142) of the agitator 117, keeping the toner carrying ability excellent in the toner storage chamber 112.

And a part of the outer side face of the thick wall portion 109*b* on the side of the developer storage chamber 102 is formed along a rotation locus of the admixing auger 104, keeping the developer carrying ability excellent in the developer storage chamber 102.

And in this embodiment, since an outer wall face of the thick wall portion 109*b* of the bulkhead 109 is a smooth face extending almost parallel along the axial direction of the agitator 117 and the agitating carrying auger 104, there is no risk that a local recess is provided on the outer wall face of the thick wall portion 109*b* of the bulkhead 109, effectively avoiding a situation where the toner or developer is not carried but remains near the bulkhead 109 between the toner storage chamber 112 and the developer storage chamber 102.

Figure 7A:
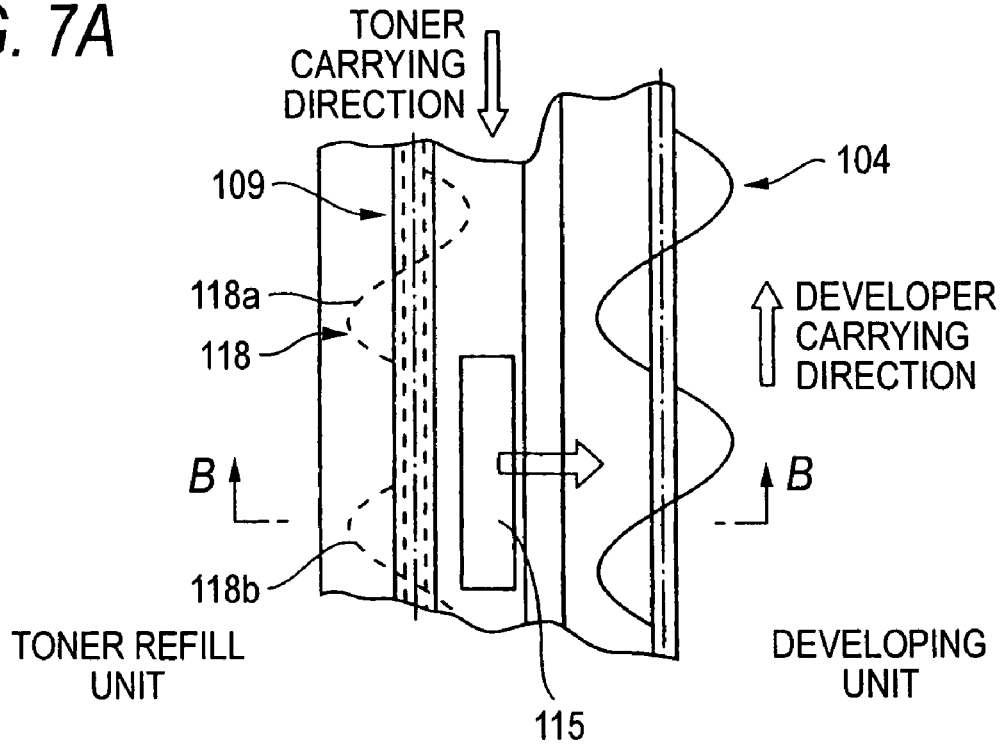
FIG. 7A is an explanatory view showing the peripheral structure of a toner supply port according to this embodiment.
Figure 7B:
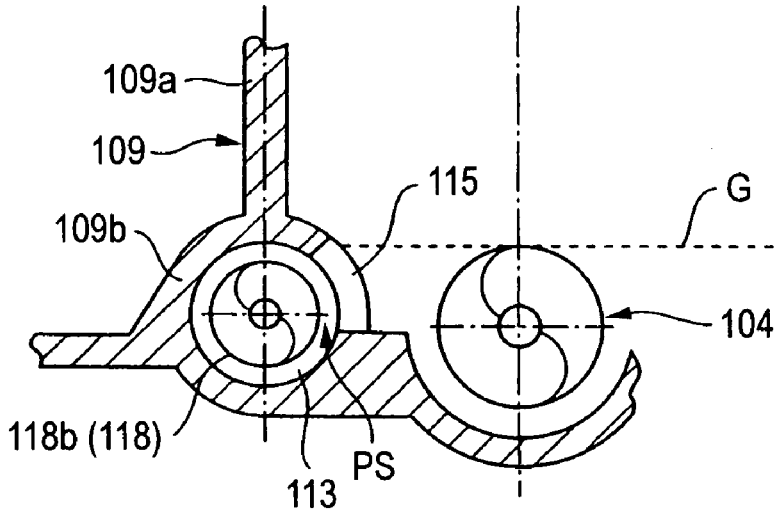
FIG. 7B is a cross-sectional view taken along the line B-B in FIG. 7A.

Also, in this embodiment, the toner supply port 115 is opened so that its lower end may be located under the surface position of the developer G stored within the developer storage chamber 102, as shown in FIGS. 7A and 7B. That is, it is necessary that the toner supply port 115 is at least buried below the surface position of the developer G within the developer storage chamber 102, whereby the refill toner T can be supplied transversely to the developer within the developer storage chamber 102, securing the agitating and mixing ability of the refill toner T with the developer without floating the refill toner T on the developer G.

Particularly, in this embodiment, a pressing force for pressing the refill toner T within the toner refill unit 110 out of the toner supply port 115 is set to more than an internal pressure of the developer G within the developer storage chamber 102.

Specifically, the dispenser inlet port 114 is formed wider than the toner supply port 115, and the length of the dispenser chamber 113 in the longitudinal direction is set to be sufficiently longer than that of the dispenser inlet port 114. Moreover, the supply amount of the toner to the dispenser inlet port 114 by the agitator 117 is set to more than the toner carrying amount (corresponding to the toner supply amount discharged out of the toner supply port 115) of the dispensing auger 118.

Moreover, regarding the radial size, the vane pitch and the number of rotations for the dispensing auger 118, the internal pressure of the toner based on the toner carrying force of the dispensing auger 118 is set to more than the internal pressure of the developer G (dependent on the carrying force of the agitating carrying auger 104) within the developer storage chamber 102 exerted on the toner supply port 115.

Also, in this embodiment, the dispensing auger 118 has an auger vane 118*a* for normal agitation and carry and additionally an auger vane 118*b* for stem in a portion facing the toner supply port 115, in which the auger vane 118*b* for stem acts as a pressing portion PS to force the stemmed toner T out of the toner supply port 115 to the developer storage chamber 102, as shown in FIGS. 7A and 7B.

In this embodiment, the toner supply port 115 is opened at a position away from the end position of the developer storage chamber 102, but the refill toner T is forced out of the toner supply port 115 due to a pressure from the auger vane 118*b* for stem.

Moreover, in this embodiment, since an upper end of the toner supply port 115 is located below the upper end portion of the admixing auger 104, the toner is refilled from below the upper end portion of the admixing auger 104, so that the refilled toner is entangled into the admixing auger 104, and rapidly agitated and mixed.

Moreover, since the lower end of the toner supply port 115 is set below the rotation center of the admixing auger 104, the toner T is refilled from below the rotation center of the admixing auger 104, so that the refilled toner T is entangled into the admixing auger 104, and rapidly agitated and mixed.

Also, since the center of the dispensing auger 118 is located at or below the rotation center of the admixing auger 104, the toner is refilled from below the rotation center of the admixing auger 104, so that the refilled toner T is entangled into the admixing auger 104, and rapidly agitated and mixed.

With respect to the capacity of the toner storage chamber 112, if the capacity of the toner storage chamber 112 is greater than the capacity of the dispenser chamber 113, or the total capacity of the dispenser chamber 113 and the developer storage chamber 102, the toner from the toner supply port 115 can be refilled stably and continually. The capacity as used herein means the toner storage amount or the developer storage amount.

Moreover, in this embodiment, the rotation center of the agitators 116, 117 is located above the dispensing auger 118 and the agitating carrying augers 104 and 105.

Therefore, it is unnecessary to lift the toner T from the toner storage chamber 112 to the dispenser chamber 113 and the developer storage chamber 102, whereby the internal pressure of toner within the dispenser chamber 113 can be effectively increased to smoothly refill the toner into the developer storage chamber 102 without losing the internal pressure of toner within the dispenser chamber 113.

Figure 8A:
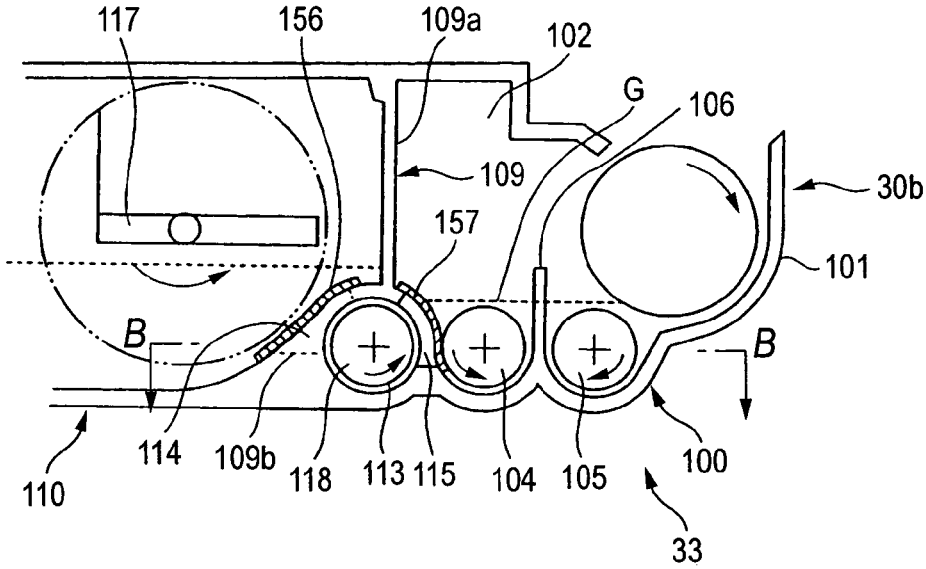
FIG. 8A is an explanatory view showing a state of the developing cartridge for use in this embodiment, at the start time of use.
Figure 8B:
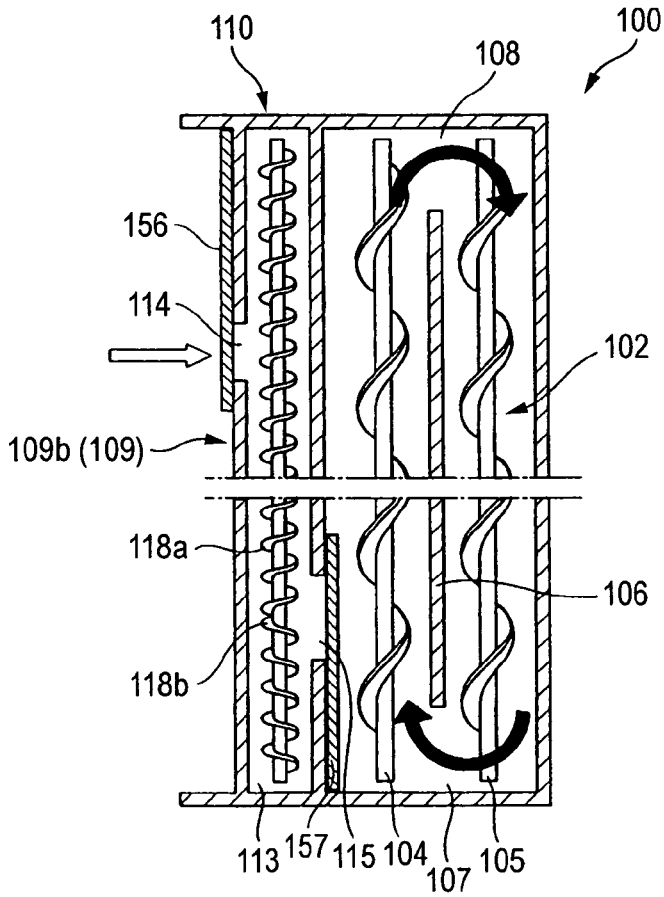
FIG. 8B is a cross-sectional view taken along the line B-B in FIG. 8A.

Also, in this embodiment, the main toner refill unit 110 has the dispenser inlet port 114 and the toner supply port 115 covered with the seal members 156 and 157 before the start of use, as shown in FIGS. 8A and 8B.

The seal member 156, 157 is formed like a film, the material being a polyethylene film, a polypropylene film or a laminate product thereof. And this seal member 156, 157 is pasted peelably by heat welding or bonding. This seal member 156, 157 has an extension portion in which its one end portion in the longitudinal direction is folded back outside the developing cartridge 30*b*. If the user pulls out this extension portion, the dispenser inlet port 114 and the toner supply port 115 are opened.

Herein, the seal member 156, 157 is not limited to the film-like form, but may be a lid that can be opened or closed on the face of the dispenser inlet port 114 or the toner supply port 115. In this case, a method for opening the seal member can be appropriately chosen. For example, the cartridge receiving portion is provided with an engaged portion engageable with the seal member, when the process cartridge 30 is mounted, and the seal member is engaged with the engaged portion and opened in linkage with an operation of mounting the process cartridge 30, or the seal member of the lid constitution is biased beforehand in a closing direction by biasing means such as a biasing spring, and opened in a direction against the biasing means by an operation of the user.

Accordingly, in this embodiment, the main toner refill unit 110 enables the dispenser chamber 113 to be tightly closed with the seal member 156, 157 when not in use, so that the developer is filled into the dispenser chamber 113 during transportation, with less risk of causing the blinding.

Though in this embodiment, the seal members 156, 157 are provided for the dispenser inlet port 114 and the toner supply port 115, it is unnecessary to provide the seal member 157 on the side of the toner supply port 115 in the form in which the developer within the developer storage chamber 102 is isolated to be inputted initially when in use (the developer is not stored beforehand within the developer circulation path of the developer storage chamber).

Sub Toner Refill Unit

In this embodiment, the sub toner refill unit 120 has a sub refill housing 121 adjacent to the back side of the cleaning unit 200, and a toner refill chamber 122 in which the refill toner T can be refilled within the sub refill housing 121, as shown in FIG. 3.

And one pair of agitators 123 and 124 for agitating and carrying the refill toner T are disposed within the toner refill chamber 122.

Figure 9:
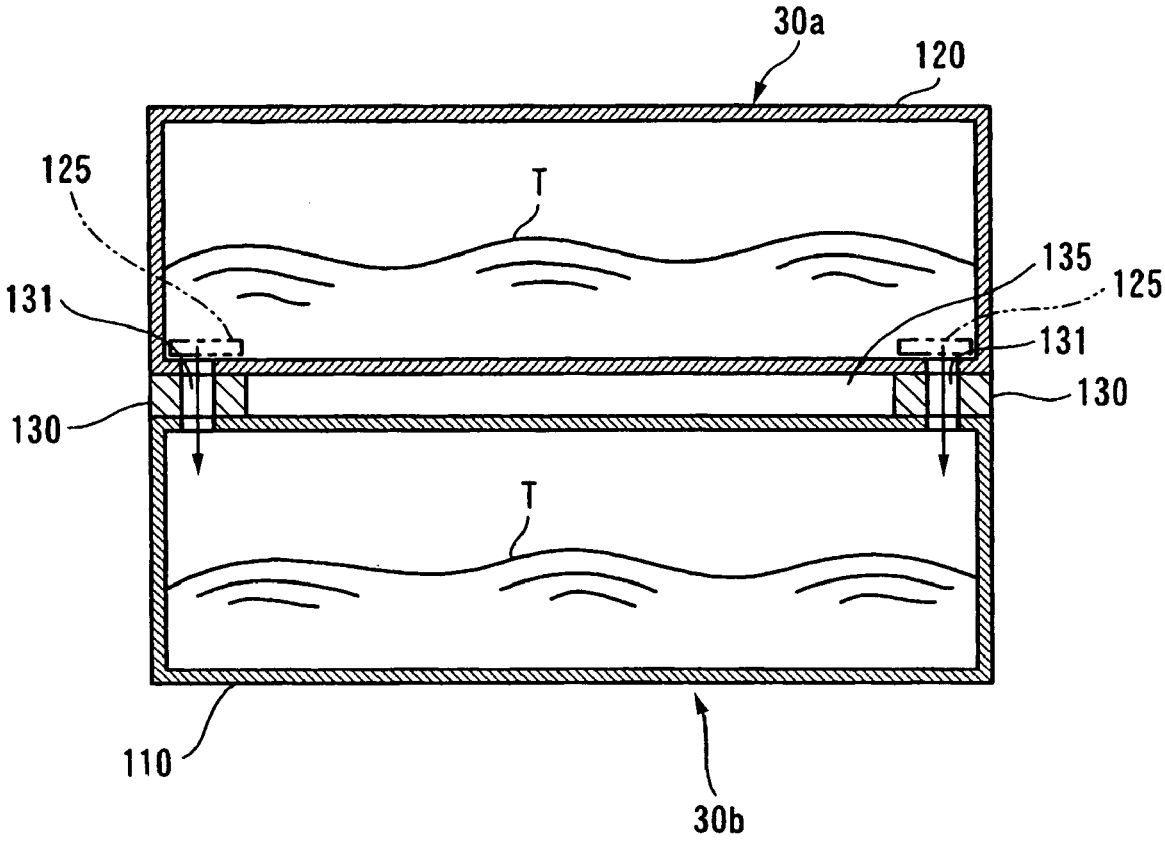
FIG. 9 is an explanatory view showing a communication structure example between a main toner refill unit and a sub-toner refill unit.

Herein, a communication structure between the sub toner refill toner 120 and the main toner refill unit 110 is a communication passage (toner supply passage) 131 formed in a spacer 130 made of elastic material, as shown in FIGS. 3 and 9. Though in this embodiment, the spacers 130 are provided at two positions on both sides between the units 110 and 120, each spacer being formed with the toner supply path 131, any one of the spacers 130 may be formed with the toner supply path 131, or the spacer 130 may be provided at one position on one side and formed with the toner supply path 131.

In this embodiment, it is preferred that a connection portion of this sub toner refill unit 120 with the toner supply path 131 is closed with an openable seal member 125, when not in use, as indicated by the imaginary line in FIG. 9. In this case, when the process cartridge 30 is not in use (e.g., during transportation), there is no risk that the toner within the sub toner refill unit 120 enters the toner supply path 131, causing the blinding, and it is possible to effectively avoid a situation where the toner within the sub toner refill unit 120 is filled one-sidedly in the main toner refill unit 110, unnecessarily increasing the fill density of the toner within the main toner refill unit 110.

And in this embodiment, if a predetermined amount of toner T is refilled from the main toner refill unit 110 to the developing unit 100, the toner T within the sub toner refill unit 120 is replenished into the main toner refill unit 110 at the same time. Therefore, a fixed amount of the toner T is filled in the main toner refill unit 110 until the sub toner refill unit 120 becomes empty, whereby the weight change of the developing cartridge 30*b* is suppressed small.

Since the photosensitive cartridge 30*a* is securely positioned in the cartridge receiving portion of the apparatus housing 21 at this time, a change in the toner storage amount of the sub toner refill unit 120 has no influence on the weight change of the developing cartridge 30*b*.

Hence, a variation in the pressing biasing force of the developing cartridge 30*b* to the photosensitive cartridge 30*a* is suppressed, until the sub toner refill unit 120 becomes empty, so that the image disorder is effectively prevented.

Moreover, since the photosensitive cartridge 30*a* is securely positioned in the apparatus housing 21, at least the position of the lower side face of the photosensitive cartridge 30*a* forming the scanning passage 135 is not changed, so that there is no risk that the scanning passage 135 is intercepted, even if the position of the developing cartridge 30*b* swingably supported on the photosensitive cartridge 30*a* is varied.

Cleaning Device

Figure 10:
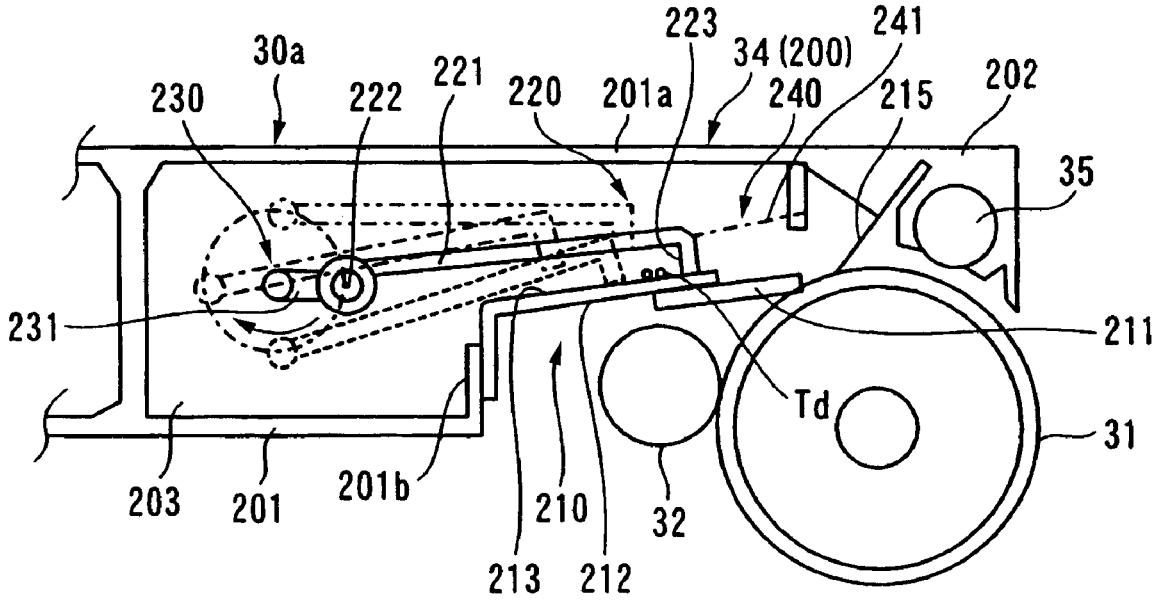
FIG. 10 is an explanatory view showing the essence of a cleaning device for use in this embodiment.

In this embodiment, the cleaning device 34 is incorporated as a cleaning unit 200 into the photosensitive cartridge 30*a*, as shown in FIG. 10.

This cleaning unit 200 has a cleaning housing 201 with an opening opposed to the photosensitive drum 31, and a waste toner storage chamber 203 that can store the waste toner within the cleaning housing 201, in which an upper wall 201*a* of the cleaning housing 201 extends like a visor toward the photosensitive drum 31.

And a cleaning blade 210 is disposed at a lower edge portion 201*b* of the opening of the cleaning housing 201. In this cleaning blade 210, a blade holder 212 like L-character is attached on a side wall portion (not shown) suspended from both sides of the lower edge portion 201*b* of the opening and the upper wall 201*a* in the cleaning housing 201, and a blade main body 211 made of elastic material such as urethane rubber is attached outside the distal end portion of this blade holder 212, the distal end of the blade main body 211 being elastically contacted against the rotation direction (counter-clockwise direction in FIG. 10) of the photosensitive drum 31.

On the other hand, a film seal 215 made of PET or polyurethane is provided at an upper edge portion (near the top end of the upper wall 201*a* in this embodiment) of the opening of the cleaning housing 201, in which the distal end portion of this film seal 215 is elastically contacted along the rotation direction of the photosensitive drum 31 to prevent the waste toner withdrawn by the cleaning blade 210 from splashing.

In this embodiment, the cleaning blade 210 except for an attaching portion on the cleaning housing 201 is disposed almost parallel to a visor portion of the upper wall 201*a* for the cleaning housing 201, and a waste toner reservoir 213 (corresponding to an inner face of the blade holder 212 in this embodiment) temporarily reserves the waste toner scraped by the cleaning blade 210. Particularly, in this embodiment, the waste toner reservoir 213 is on the downgrade toward the waste toner storage chamber 203, increasing the ability of carrying the waste toner T.

In this embodiment, the waste toner reservoir 213 is composed of the cleaning blade 210 only, but may comprise a part of the cleaning housing 201, besides the cleaning blade 210.

Since a space becoming a recess portion for the photosensitive drum 31 is secured between the cleaning housing 201 and the cleaning blade 210, the charging roll 32 is disposed employing this recess portion.

A holding block 202 for the erase lamp 35 is integrally provided at the top end of the upper wall 201*a* of the cleaning housing 201.

Moreover, in this embodiment, a waste toner carrying member 220 for carrying the waste toner Td scraped by the cleaning blade 210 to the waste toner storage chamber 203 is provided within the cleaning housing 201.

This waste toner carrying member 220 has a carrying blade 221 as a member element spanning from the waste toner storage chamber 203 to the waste toner reservoir 213, in which a drive input portion 222 that can input a driving force from the outside is provided at an end portion of the carrying blade 221 on the side of the waste toner storage chamber 203, and a protruding portion 223 that can contact the waste toner reservoir 213 is provided at an end portion of the carrying blade 221 on the side of the photosensitive drum 31.

Herein, the carrying blade 221 may be like a plate, but from the viewpoint of reducing the weight and avoiding the deposition of the waste toner Td on the upper face effectively, the carrying blade 221 is preferably formed with an opening 224 in a portion other than the protruding portion 223 of the carrying blade 221 and the drive input portion 222. Also, the formation portion of the protruding portion 223 is not necessarily the end portion of the carrying blade 221, but may be located away from the end portion, and the number of protruding portions 223 may be at least one or more. Moreover, a method of forming the protruding portion 223 may involve bending the distal end portion of the carrying blade 221, or forming the protruding portion 223 integrally or separately in a part of the carrying blade 221.

A member element of the waste toner carrying member 220 is not necessarily the carrying blade 221, but has a frame structure, for example.

And in this embodiment, a driving force of rotation locus is inputted into the drive input portion 222 of the waste toner carrying member 220, as shown in FIG. 10. This driving force of rotation locus is easily obtained by rotating and driving a crank shaft 231 that is a rotation driving mechanism 230 of one kind around the center of rotation.

Moreover, in this embodiment, the waste toner carrying member 220 is additionally provided with an attitude regulation mechanism 240 for regulating the movement attitude of the waste toner carrying member 220.

In this embodiment, the attitude regulation mechanism 240 has a biasing spring 241 with one end engaging the protruding portion 223 of the waste toner carrying member 220, and the other end engaging a part of the cleaning housing 201, whereby the waste toner carrying member 220 is biased in a direction farther away from the drive input portion 222.

Particularly, in this embodiment, the biasing spring 241 is disposed obliquely in a forward or backward direction of the waste toner carrying member 220.

Figure 11B:
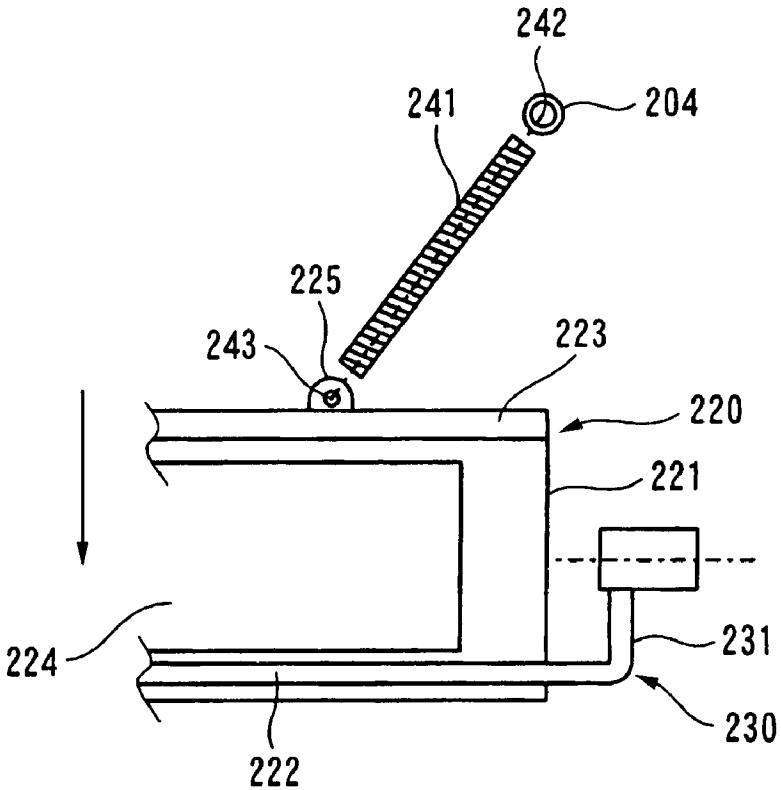
FIGS. 11A and 11B are explanatory views showing the operation states of a biasing spring when a waste toner carrying member is moved forward or backward.
Figure 11A:
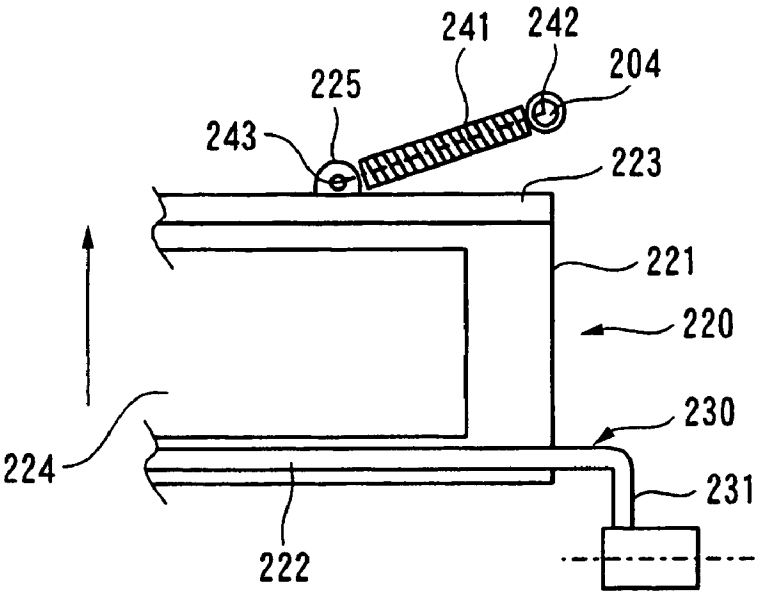

Herein, in an attaching structure of the biasing spring 241, the engaging hooks 242 and 243 are provided at both ends of the biasing spring 241, in which one engaging hook 242 is engaged with an engaging projection 204 on the side of the cleaning housing 201, and the other engaging hook 243 is engaged with an engaging piece 225 provided at an end portion of the waste toner carrying member 220 on the side of the protruding portion 223, as shown in FIGS. 10 and 11.

Though in this embodiment, the engaging projection 204 is provided within the cleaning housing 201 in the attaching structure of the biasing spring 241, an engagement hole may be opened the cleaning housing 201 in communication with the outside, for example, although there is a risk that the waste toner leaks. In this case, the engagement hole may be sealed with a seal member. This seal member may be preferably a label pasted on the CRU.

In this way, in the case where the biasing spring 241 is additionally provided in the waste toner carrying member 220, when a driving force of rotation locus is inputted into the drive input portion 222 of the waste toner carrying member 220, the protruding portion 223 of the waste toner carrying member 220 is moved forward or backward along the waste toner reservoir 213, following the rotation locus, as shown in FIGS. 10 and 11.

At this time, the biasing spring 241 regulates a range where the attitude of the waste toner carrying member 220 is changed according to a positional change of the drive input portion 222 for the waste toner carrying member 220. In this embodiment, when the waste toner carrying member 220 is moved backward, the protruding portion 223 is moved along the waste toner reservoir 213 in contact with the waste toner. When the waste toner carrying member 220 is moved forward, the protruding portion 223 is moved out of contact with the waste toner on the waste toner reservoir 213. A specific behavior will be described later.

Particularly, in this embodiment, since the biasing spring 241 is disposed obliquely in the forward or backward direction of the waste toner carrying member 220, the disposed space can be saved, and the expansion amount of the biasing spring 241 can be set to less than the movement amount of the waste toner carrying member 220, so that a variation in the driving force load on the waste toner carrying member can be relieved.

The operation of the cleaning device 34 for use in this embodiment will be described below.

Figure 12A:
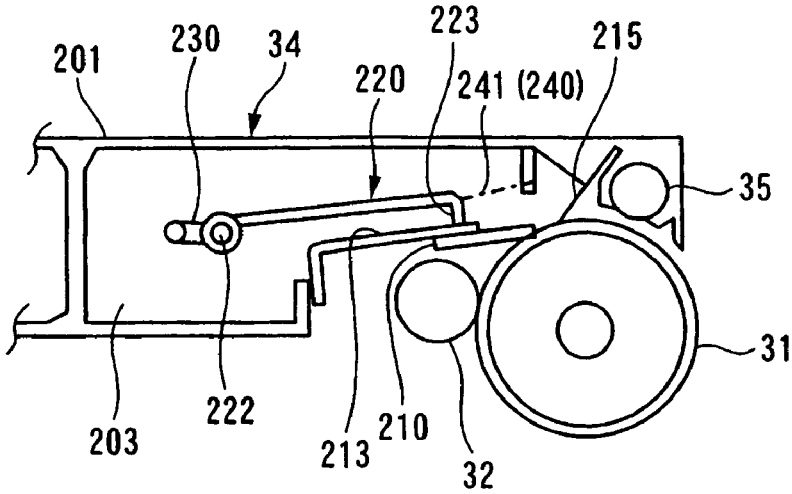
FIGS. 12A to 12C are explanatory views showing the operation states of the waste toner carrying member when moved backward in the cleaning device according to the embodiment 1.

As shown in FIGS. 10 and 12A, if the residual toner on the photosensitive drum 31 is scraped by the cleaning blade 210, the scraped waste toner Td deposits on or near the cleaning blade 210, although the waste toner Td deposits on the waste toner reservoir 213 (corresponding to an inner face of the blade holder 211 in this embodiment).

In this state, when the drive input portion 222 of the waste toner carrying member 220 is located as shown in FIG. 12A, the waste toner carrying member 220 is placed at the most advanced position.

At this time, the biasing spring 241 biases the waste toner carrying member 220 in a direction away from the drive input portion 222, but the protruding portion 223 of the waste toner carrying member 220 makes contact with the waste toner on the waste toner reservoir 213, if a certain component of the biasing force of the biasing spring 241 is exerted in a direction forcing the protruding portion 223 of the waste toner carrying member 220 into contact with the waste toner on the waste toner reservoir 213 by adjusting the relationship between the position of the drive input portion 222 for the waste toner carrying member 220 and the position of engagement point of the biasing spring 241 on the side of the cleaning housing 201.

Figure 12B:
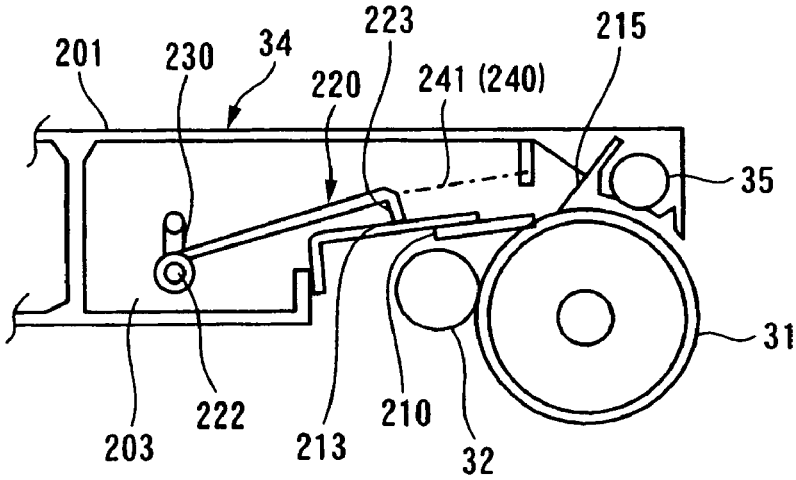

If the position of the drive input portion 222 is rotated downward from this state by the rotation drive mechanism 230, the waste toner carrying member 220 is moved backward while being gradually inclined, whereby the protruding portion 223 of the waste toner carrying member 220 carries the waste toner on the waste toner reservoir 213 to the waste toner storage chamber 203, as shown in FIG. 12B.

And if the drive input portion 222 of the waste toner carrying member 220 reaches the lowest point, the attitude of the waste toner carrying member 220 is inclined most steeply. However, from the viewpoint of keeping a contact state between the protruding portion 223 of the waste toner carrying member 220 and the waste toner reservoir 213, it is efficient that the portion of the waste toner carrying member 220 except for the protruding portion 223 of is out of contact with the waste toner reservoir 213.

Figure 12C:
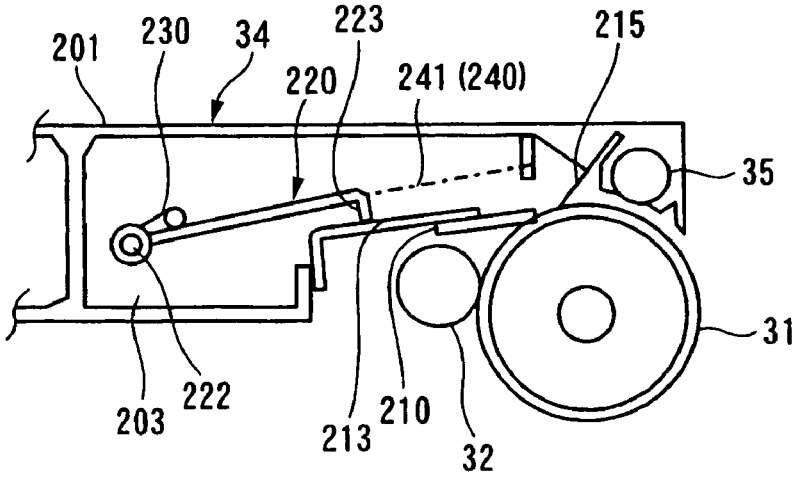

Thereafter, if the drive input portion 222 of the waste toner carrying member 220 is rotated to a position of FIG. 12C, the waste toner carrying member 121 is further moved backward while being gradually released from the inclined attitude. At this time, since the biasing spring 241 keeps on pressing the waste toner carrying member 220 against the waste toner reservoir 213, the protruding portion 223 of the waste toner carrying member 220 is moved along the waste toner reservoir 213 in contact with the waste toner Td, moving the waste toner Td into the waste toner storage chamber 203.

Figure 13A:
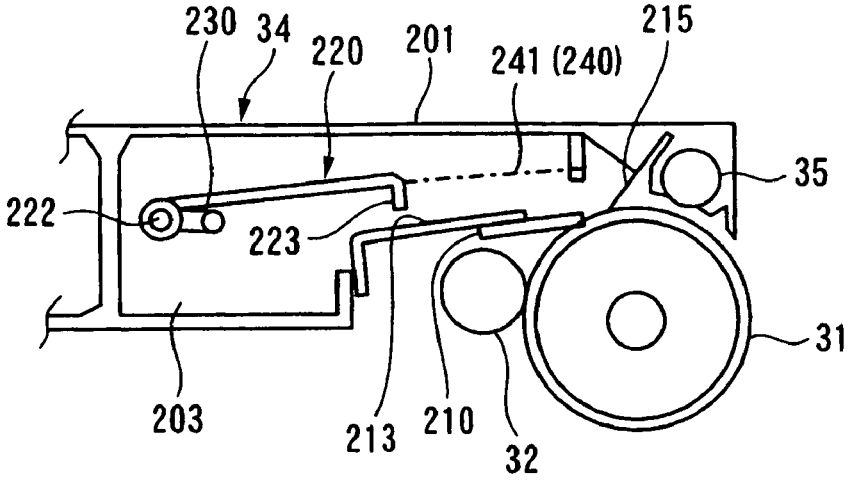
FIGS. 13A to 13C are explanatory views showing the operation states of the waste toner carrying member when moved forward.

In this embodiment, even if the waste toner carrying member 220 reaches the most backward position, the protruding portion 223 of the waste toner carrying member 220 is not moved up to an end portion of the waste toner reservoir 213 closer to the waste toner storage chamber 203, but the waste tone carried near the end portion of the waste toner reservoir 213 closer to the waste toner storage chamber 203 is pressed by the waste toner carried later, and stored successively in the waste toner storage chamber 203, as shown in FIGS. 12C and 13A.

Also, in this embodiment, if the waste toner carrying member 220 reaches the most backward position, the waste toner carrying member 220 is pulled by a biasing force of the biasing spring 241, so that the protruding portion 223 of the waste toner carrying member 220 is separated from the waste toner on the waste toner reservoir 213, leading to a state immediately before contact, as shown in FIG. 13A.

That is, since the waste toner carrying member 220 is urged in a predetermined direction by the biasing spring 241, the disposition attitude of the waste toner carrying member 220 is determined, based on the relationship between the position of the drive input portion 222 for the waste toner carrying member 220 and the position of engagement point of the biasing spring 241 on the side of the cleaning housing 201. At this time, as a layout, the protruding portion 223 of the waste toner carrying member 220 is disposed out of contact with the waste toner on the waste toner reservoir 213 at a stage where the waste toner carrying member 220 transits to the advancing movement.

Figure 13B:
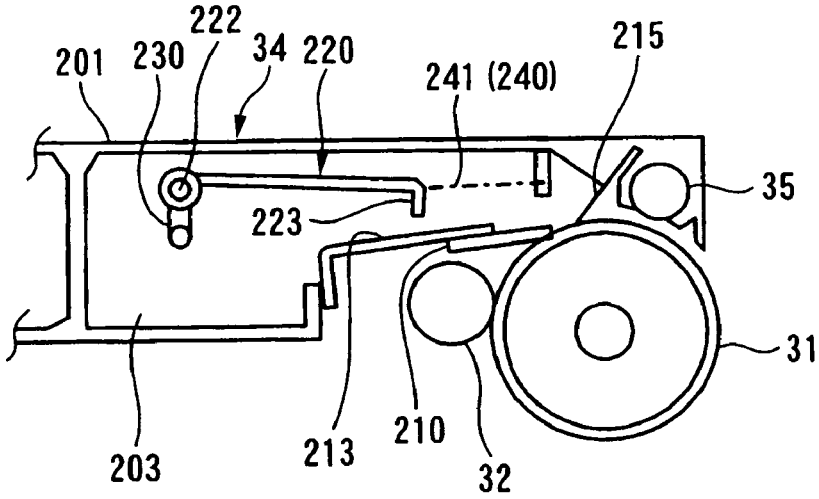

Thereafter, if the drive input portion 222 of the waste toner carrying member 220 is rotated upwards, the waste toner carrying member 220 is advanced while changing the inclined attitude so that the drive input portion 222 is raised, as shown in FIG. 13B.

At this time, the waste toner carrying member 220 is urged by the biasing spring 241. If the position of the drive input portion 222 for the waste toner carrying member 220 is raised, the disposed position of the waste toner carrying member 220 is further raised, whereby the protruding portion 223 of the waste toner carrying member 220 is kept out of contact with the waste toner on the waste toner reservoir 213.

Figure 13C:
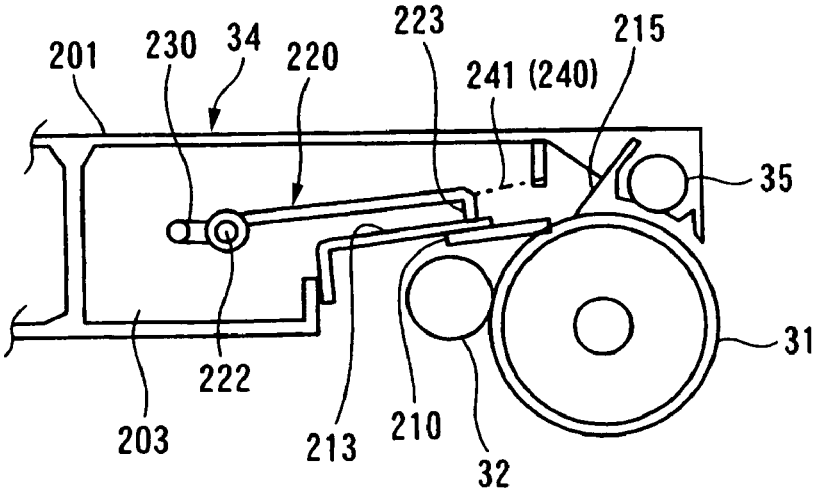

Thereafter, if the drive input portion 222 of the waste toner carrying member 220 is rotated downwards from the upper dead center position, the waste toner carrying member 220 is advanced while changing the inclined attitude again, and gradually approaches the waste toner reservoir 213, as shown in FIG. 13C. And at the point of time when the waste toner carrying member 220 reaches the most advanced position, the protruding portion 223 of the waste toner carrying member 220 is disposed in contact with the waste toner on the waste toner reservoir 213 again.

In this way, when the waste toner carrying member 220 is advanced, the protruding portion 223 of the waste toner carrying member 220 is moved out of contact with the waste toner on the waste toner reservoir 213, whereby it is possible to effectively avoid a situation where the waste toner on the waste toner reservoir 213 is pushed back along with the advancing movement of the waste toner carrying member 220. As a result, the waste toner carrying ability is kept excellent.

In the following, the operation of FIGS. 12A to 12C and FIGS. 13A to 13C is repeated.

Though in this embodiment, the waste toner carrying member 220 is all moved in contact with the waste toner on the waste toner reservoir 213, when moved backward, the waste toner carrying member 220 may be moved out of contact with the waste toner on the waste toner reservoir 213 at the beginning in a backward movement area, and moved in contact with the waste toner halfway. Also, though the waste toner carrying member 220 is all moved out of contact with the waste toner on the waste toner reservoir 213, when moved forward, the waste toner carrying member 220 may be moved in contact with the waste toner on the waste toner reservoir 213 at the beginning in a forward movement area, and moved out of contact with the waste toner halfway.

Particularly, in this embodiment, when the drive input portion 222 is at the upper dead center position, the waste toner carrying member 220 keeps the almost horizontal uppermost attitude, and is moved forward along a locus not exceeding the uppermost attitude, while keeping the almost horizontal attitude. Therefore, the upper space of the waste toner storage chamber and the upper space of the waste toner reservoir 213 can be narrower, making the cleaning device 34 thinner.

Also, in this embodiment, since the waste toner carrying member 220 has the opening 224, there is no risk that the waste toner deposits on the waste toner carrying member 220 when the waste toner is carried by the waste toner carrying member 220. Also, there is no risk that the waste toner may splash due to a wind pressure caused by air pressure.

Moreover, though in this embodiment, the waste toner carrying member 220 is moved in contact along the waste toner reservoir 213, when moved backward, the waste toner carrying member 220 may be moved out of contact with the waste toner reservoir 213, but in contact with the waste toner on the waste toner reservoir 213. In this case, advantageously, there is less risk that the vibration is unnecessarily passed to the photosensitive drum 31 along with the movement of the waste toner carrying member 220, because the waste toner carrying member 213 is out of direct contact with the waste toner reservoir 213, when moved backward.

Drive System for Developing Device and Cleaning Device

In this embodiment, a drive system 300 for the developing device 33 and the cleaning device 34 may be appropriately selected, but the following system can be employed.

Figure 14:
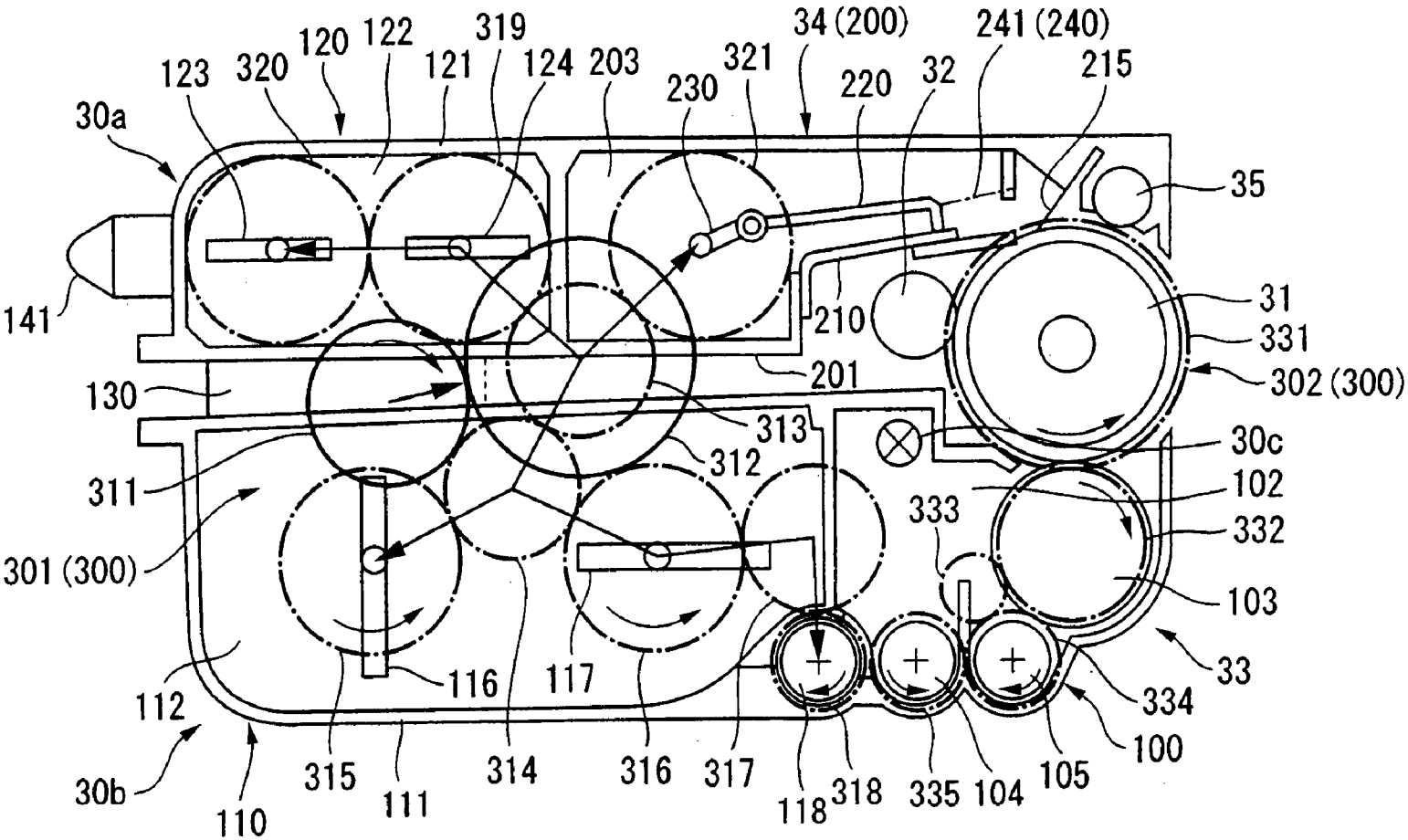
FIG. 14 is an explanatory view exemplifying a conveyance drive system and a development drive system for use in this embodiment.

That is, the drive system 300 for use in this embodiment comprises a carrying drive system 301 for driving all the driven elements of the toner refill units 110 and 120 for the developing device 33 and the driven elements of the cleaning unit 200 as the cleaning device 34 with the same drive source, and a development drive system 302 for driving the driven elements of the developing unit 100 for the developing device 33, employing a different drive source from the carrying drive system 301, as shown in FIG. 14.

Herein, the carrying drive system 301 has a drive input gear 311 driven and linked by a drive source, not shown, in which this drive input gear 311 is meshed with a drive transmission gear 312 at the first stage, a coaxial transmission gear 313 is provided coaxially with the drive transmission gear 312, the coaxial transmission gear 313 being meshed with the drive transmission gears 315 and 316 leading to the agitators 116 and 117 of the main toner refill unit 110 via an idler gear 314, and one drive transmission gear 316 is meshed with a dispense gear 318 leading via an idler gear 317 to the dispensing auger 118.

Also, in this carrying drive system 301, the coaxial transmission gear 313 is meshed with the drive transmission gears 319 and 320 leading to the agitators 123 and 124 of the sub toner refill unit 120, and a drive transmission gear 321 leading to a rotation shaft of the rotation drive mechanism 230 of the cleaning unit 200.

On the other hand, the development drive system 302 is provided with a drive transmission gear 331 coaxial with the photosensitive drum 31, the drive transmission gear 331 is meshed with a drive transmission gear 332 leading to the developing roll 103, and further the drive transmission gear 332 is meshed sequentially with the drive transmission gears 334 and 335 leading to the agitating carrying augers 105 and 104 via an idler gear 333.

The drive source for the development drive system 302 and the drive source for the carrying drive system 301 are different, but may be the same as far as they can be driven independently.

In this way, with this embodiment, since the carrying drive system 301 and the development drive system 302 are different, it is unnecessary to drive the toner carrying members (agitators 116 and 117, dispensing auger 118, agitators 123 and 124) and the waste toner carrying member 220 at any time during the developing operation, unlike the form in which the development drive system 302 and the carrying drive system 301 are linked, suppressing the energy loss of driving at any time and the wear deterioration of the toner carrying member and the waste toner carrying member 220, and increasing the life of the process cartridge 30.

Since the toner carrying member or waste toner carrying member 220 with great load variations and the photosensitive drum 31 or developing roll 103 requiring the rotation accuracy, are driven separately, the vibration caused by load variations of the toner carrying member or waste toner carrying member 220 has no influence on the rotation of the photosensitive drum 31 or the developing roll 103, preventing in advance the image defect from occurring.

Moreover, in this embodiment, the photosensitive drum 30*a* is securely positioned in the apparatus housing 21, the drive transmission gear 312 meshed with the drive input gear 311 is supported, together with the coaxial transmission gear 313, on the photosensitive cartridge 30*a* at the secured side. Therefore, a drive input from the drive input gear 311 is stably performed.

Moreover, if the carrying drive system 301 is provided with a disconnection element (oscillating gear) that can disconnect the drive to each drive element of the toner refill units 110 and 120, the waste toner carrying operation may be performed separately from the toner refill operation. Also, if a disconnection element capable of disconnecting the drive to a part of the drive element of the toner refill unit 110, for example, the dispensing auger 118, is provided, the toner refill operation by the dispensing auger 118 is not performed, but the agitation carrying operation of the agitators 116, 117, 123 and 124 within the toner refill units 110 and 120 may be only performed to agitate the refill toner periodically.

Embodiment 2

Figure 15:
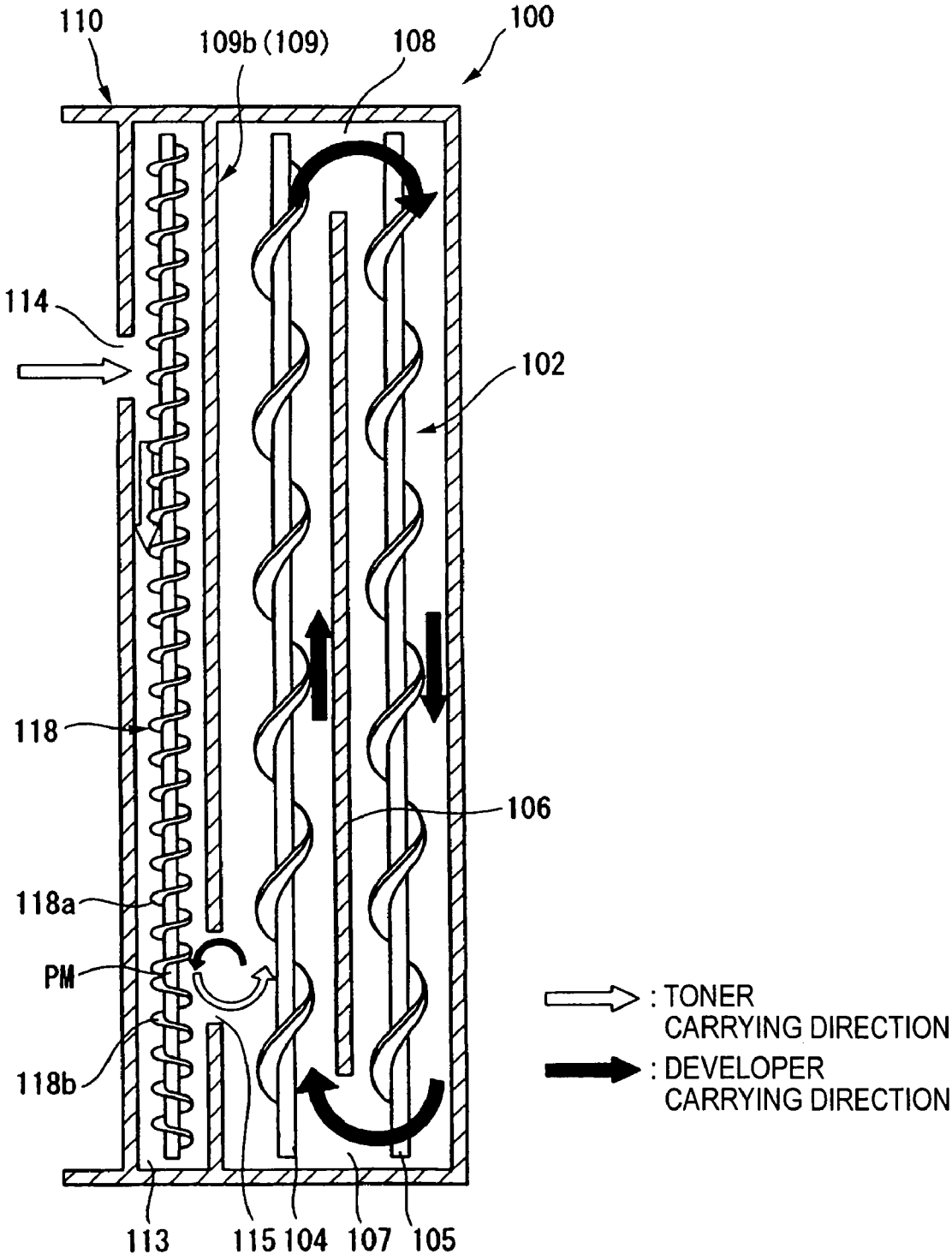
FIG. 15 is an explanatory view showing the essence of the developing device according to an embodiment 2 of the invention.
Figure 16A:
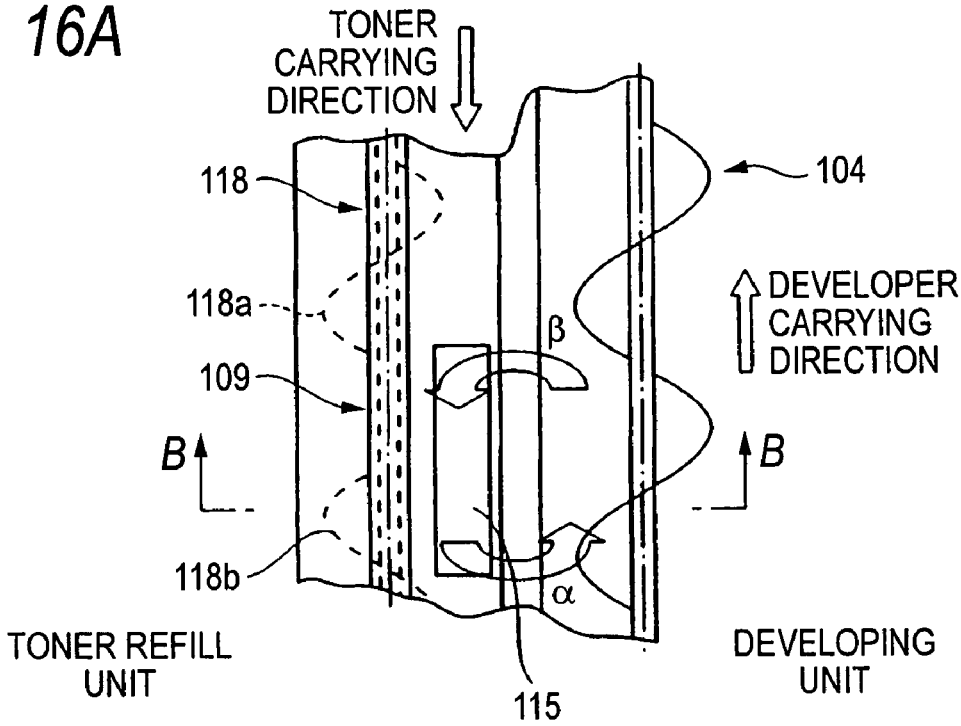
FIG. 16A is an explanatory view showing the peripheral structure of a toner supply port for the developing device according to the embodiment 2.
Figure 16B:
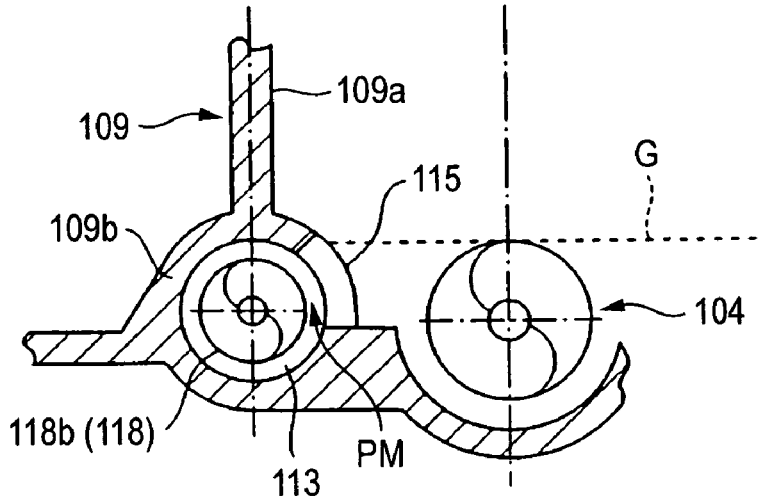
FIG. 16B is a cross-sectional view taken along the line B-B in FIG. 16A.

FIG. 15 and FIGS. 16A and 16B are explanatory views showing the essence of the developing device according to an embodiment 2 of the invention.

In FIGS. 15 and 16, the basic constitution of the developing device is substantially the same as the embodiment 1, comprising the dispenser chamber 113 within the thick wall portion 109*b* of the bulkhead 109 for partitioning the developer storage chamber 102 and the toner storage chamber 112, and the toner supply port 115 in the dispenser chamber 113, but is different from the peripheral structure of the toner supply port 115. The same or like parts are designated by the same numerals as in the embodiment 1, and are not described in detail here.

In this embodiment, the toner supply port 115 is opened so that its lower end may be located below the surface position of the developer G stored in the developer storage chamber 102, and the refill toner T is supplied to the developer storage chamber 102, a part of the developer G in the developer storage chamber 102 being flowed backward in a direction (of arrow β) reverse to the refill toner supply direction (of the arrow α), as shown in FIGS. 16A and 16B.

Specifically, like the embodiment 1, the toner carrying direction in a portion facing the toner supply port 115 within the dispenser chamber 113 and the developer carrying direction in a portion facing the toner supply port 115 within the developer storage chamber 102 are reverse, but in this embodiment, a sufficient shearing force is produced at an interface between the refill toner T and the developer G to generate a circulating flow as indicated by α and β in the toner T and the developer G.

Also, the dispensing auger 118, like the embodiment 1, has the auger vane 118*b* for stem in a portion facing the toner supply port 115, in addition to the auger vane 118*a* for normal agitation carry, but the auger vane 118*b* for stem in this embodiment has a slightly lower extrusion force of the toner than in the embodiment 1. The auger vane 118*b* for stem serves as a preliminary mixing portion PM for stemming and temporarily reserving the carried toner T and preliminarily mixing the toner T and the developer G in this toner reserved area.

That is, in this embodiment, the refill toner T within the dispenser chamber 113 is further preliminarily mixed near the toner supply port 115 under the action as in the embodiment 1.

More particularly, a part of the developer G carried by the agitating carrying auger (admixing auger) 104 enters the tunnel-like dispenser chamber 113 where the dispensing auger 118 is disposed through the toner supply port 115, and is carried along with the toner in an opposite direction to the developer moving direction by the rotation of the normal auger vane 118*a* of the dispensing auger 118 to come to the toner reserved area (preliminary mixed area).

At this time, the flowing developer dangles around the refill toner T, as if it were soybean flour for the rice cake with soybean flour, and is pushed out via the toner reserved area through the toner supply port 115 to the developer storage chamber 102 by the auger vane for stem 118*b* again.

When the developer is pushed out, the developer H is smeared around the refill toner T and heavier than the single toner. Accordingly, the refill toner T refilled through the toner supply port 115 is difficult to float on the surface in the flow of the developer G carried by the admixing auger 104, increasing the agitating and mixing ability of the refill toner T.

Also, in the form in which there occurs a partial counter flow phenomenon of the developer, a pressure distribution in which the refill toner T within the dispenser chamber 113 is pushed out of the toner supply port 115 has a portion of larger pressure and a portion of smaller pressure than the internal pressure of the developer G within the developer storage chamber 102, so that the refill toner T is supplied to the developer storage chamber 102 from the portion where the pressure of the refill toner T is larger than the internal pressure of the developer G within the developer storage chamber 102, or conversely, the developer G supposedly enters the dispenser chamber 113 from the portion where the pressure of the refill toner T is smaller than the internal pressure of the developer G.

Accordingly, the carrying amount, carrying speed, auger diameter, and auger pitch of the dispensing auger 118 or the admixing auger 104 are appropriately selected to permit a partial counter flow phenomenon of the developer G.

Embodiment 3

Figure 17A:
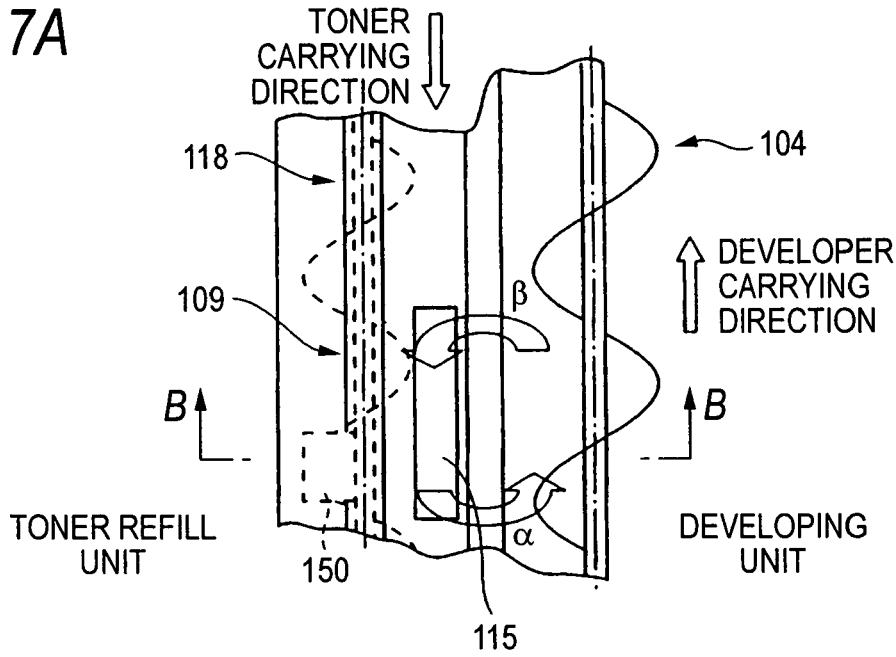
FIG. 17A is an explanatory view showing the peripheral structure of a toner supply port for the developing device according to an embodiment 3 of the invention.
Figure 17B:
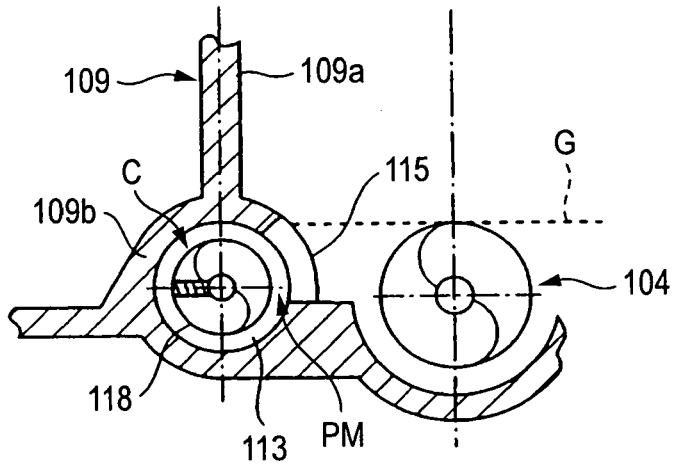
FIG. 17B is a cross-sectional view taken along the line B-B in FIG. 17A.
Figure 17C:
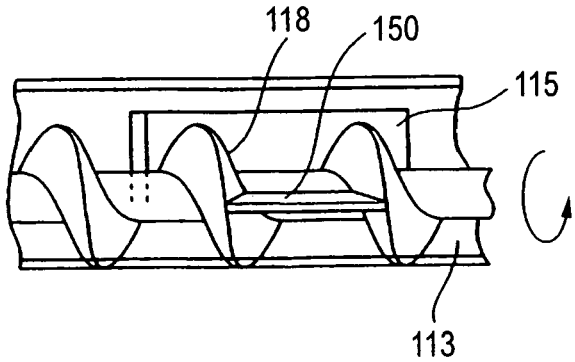
FIG. 17C is a perspective view as seen from a direction of C in FIG. 17B.

FIGS. 17A to 17C are views showing the peripheral structure of the toner supply port of the developing device according to an embodiment 3 of the invention.

In FIG. 17, the basic constitution of the peripheral structure of the toner supply port is substantially the same as the embodiment 2, in that the toner supply port 115 is opened so that its lower end is located below the surface position of the developer G stored in the developer storage chamber 102 and the toner carrying direction in a portion facing the toner supply port 115 within the dispenser chamber 113 and the developer carrying direction in a portion facing the toner supply port 115 within the developer storage chamber 102 are reverse, but is different from the embodiment 2 in that an extrusion paddle 150 is provided along the axial direction in a portion facing the toner supply port 115 within the dispensing auger 118. The same or like parts are designated by the same numerals as in the embodiment 2, and are not described in detail here.

According to this embodiment, a circulating flow (α direction, β direction) of the toner T and the developer G occurs near the toner supply port 115, like the embodiment 2, whereby the toner T and the developer G are preliminarily mixed in an area (preliminary mixing area) facing the toner supply port 115 within the dispenser chamber 113. At this time, in the preliminary mixing area, the refill toner T is extruded through the toner supply port 115 to the developer storage chamber 102, while being agitated by the extrusion paddle 150 as a preliminary mixing portion, whereby the preliminarily mixing ability of the toner T and the developer G is improved.

Also, in this embodiment, the extrusion paddle 150 works as the preliminary mixing portion. However, if the toner extrusion force of the extrusion paddle 150 is set to a great value, the extrusion paddle 150 may be configured as an extrusion portion PS to refill the refill toner in one way to the developer storage chamber 102 without causing a circulating flow in the toner supply port 115.

The process cartridge and the image forming apparatus may be constructed employing the developing device according to this embodiment. The same thing applies to the following embodiments.

Embodiment 4

Figure 18A:
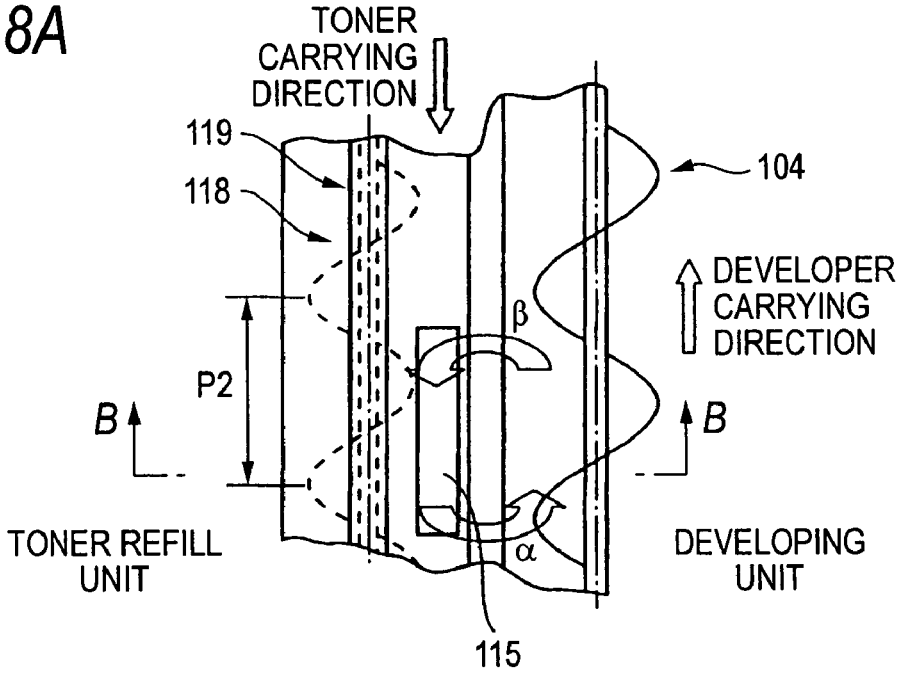
FIG. 18A is an explanatory view showing the peripheral structure of a toner supply port for the developing device according to an embodiment 4 of the invention.
Figure 18B:
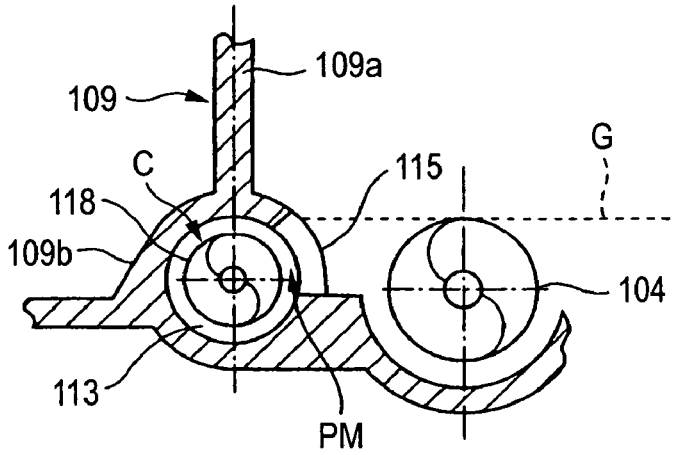
FIG. 18B is a cross-sectional view taken along the line B-B in FIG. 18A.
Figure 18C:
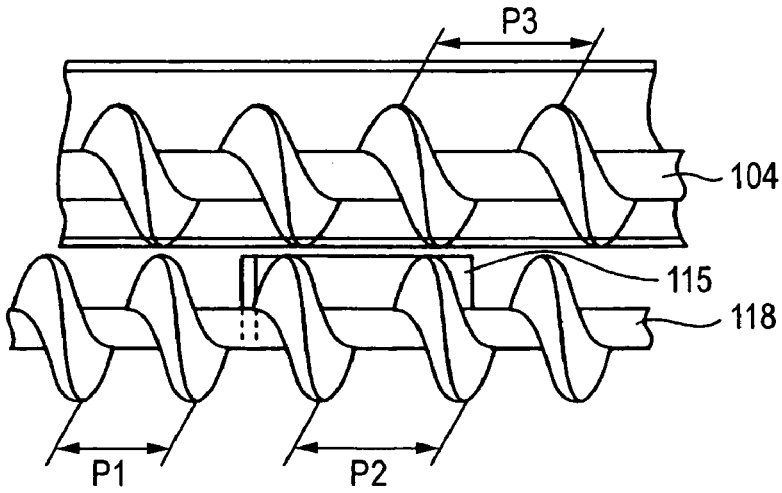
FIG. 18C is a perspective view as seen from a direction of C in FIG. 18B.

FIGS. 18A to 18C are views showing the peripheral structure of the toner supply port of the developing device according to an embodiment 4 of the invention.

In FIG. 18, the basic constitution of the peripheral structure of the toner supply port is substantially the same as the embodiment 3, in that the toner supply port 115 is opened so that its lower end is located below the surface position of the developer G stored in the developer storage chamber 102 and the toner carrying direction and the developer carrying direction in a portion facing the toner supply port 115 are reverse, but is different from the embodiment 3 in that the auger vane pitch P2 of the dispensing auger 118 in a portion facing the toner supply port 115 is wider than the other auger vane pitch P1. In this embodiment, P1 is set to 4 to 8 mm, and P2 is set to about 1.2 to two times the value of P1. P1 and P2 are appropriately selected based on the supply toner amount, in view of the number of rotations. The auger vane pitch P3 of the admixing auger 104 is appropriately selected in consideration of the toner carrying amount of the dispensing auger 118.

With this embodiment, a circulating flow (α direction, β direction) of the toner T and the developer G occurs near the toner supply port 115, like the embodiment 3, and owing to a structure (preliminary mixing portion PM) in which the auger vane pitch P2 is wider than the other auger vane pitch P1 in an area (preliminary mixing area) facing the toner supply port 115 within the dispenser chamber 113, more developer G can be taken in, whereby the preliminarily mixing ability of the toner T and the developer G is improved.

Though in this embodiment, the preliminary mixing portion is provided in the portion of the dispensing auger 118 corresponding to the toner supply port 115, the auger vane pitch P2 in the portion of the dispensing auger 118 corresponding to the toner supply portion 115 may be set to less than the other auger vane pitch P1.

In this form, the toner fill density is increased in the portion facing the toner supply port 115 within the dispenser chamber 113, so that the refill toner T is supplied transversely to the developer G in the developer storage chamber 102 through the toner supply port 115, whereby the refill toner T is securely mixed with the existent developer G by the admixing auger 104 without floating on the developer G.

At this time, a portion of the auger vane pitch P2 in the dispensing auger 118 works as the extrusion portion PS for refilling the refill toner T in one way only through the toner supply port 115.

Embodiment 5

Figure 19:
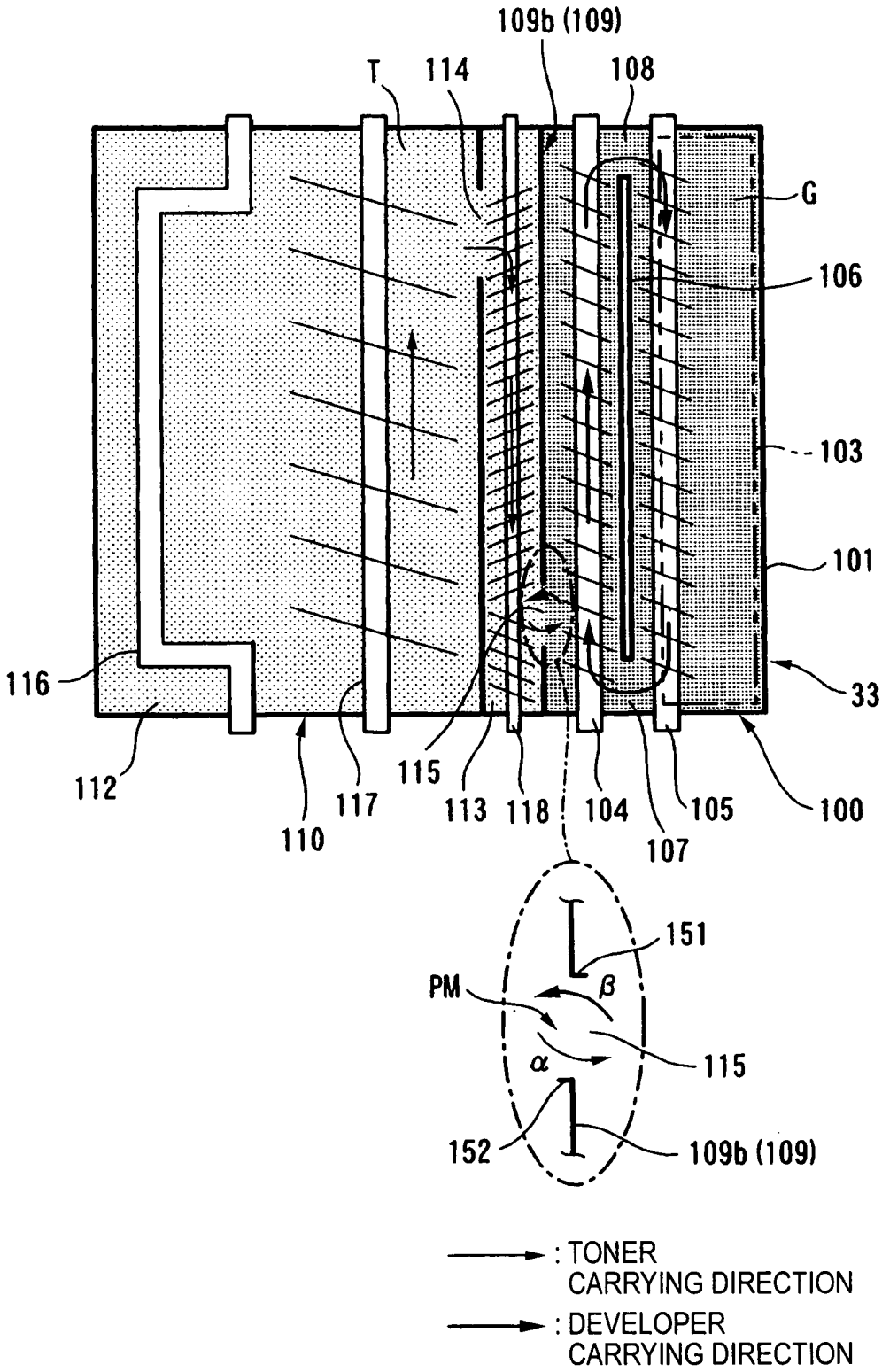
FIG. 19 is an explanatory view showing the essence of the developing device according to an embodiment 5 of the invention.

FIG. 19 is an explanatory view (corresponding to FIG. 6) showing the developing device according to an embodiment 5 of the invention.

In FIG. 19, the basic constitution of the developing device 33 is substantially the same as the embodiment 2, except that a different structure from the embodiment 2 is added around the edge portion of the toner supply port 115.

In this embodiment, the visor-like folded portions 151 and 152 are protruded to confront the directions of carrying the toner T and the developer G around the edge portion of the toner supply port 115 in a portion facing the toner supply port 115 on the downstream side of the toner carrying direction and the developer carrying direction.

According to this embodiment, one visor-like folded portion 151 extends to the developer storage chamber 102, and works to receive a part of the developer G in the developer storage chamber 102 into the toner supply port 115, while the other visor-like folded portion 152 extends to the dispenser chamber 113, and works to discharge a preliminary mixture of the toner and the developer in the dispenser chamber 113 to the toner supply port 115.

Therefore, the operation of receiving the developer G (counter flow operation of the developer) and the operation of discharging the developer (toner refill operation after preliminary mixing) are performed smoothly.

If the visor-like folded portions 151, 152 protrude too far, the toner T carrying operation and the developer G carrying operation are hindered, whereby they are appropriately set in a range (e.g., about 0.2 mm to 2 mm) without causing the trouble. That is, if the protrusion amount of the visor-like folded portions 151 and 152 is appropriately selected, the return amount of the developer G is appropriately set, whereby the preliminary mixing amount of the toner T and the developer G is adjusted.

Embodiment 6

Figure 20A:
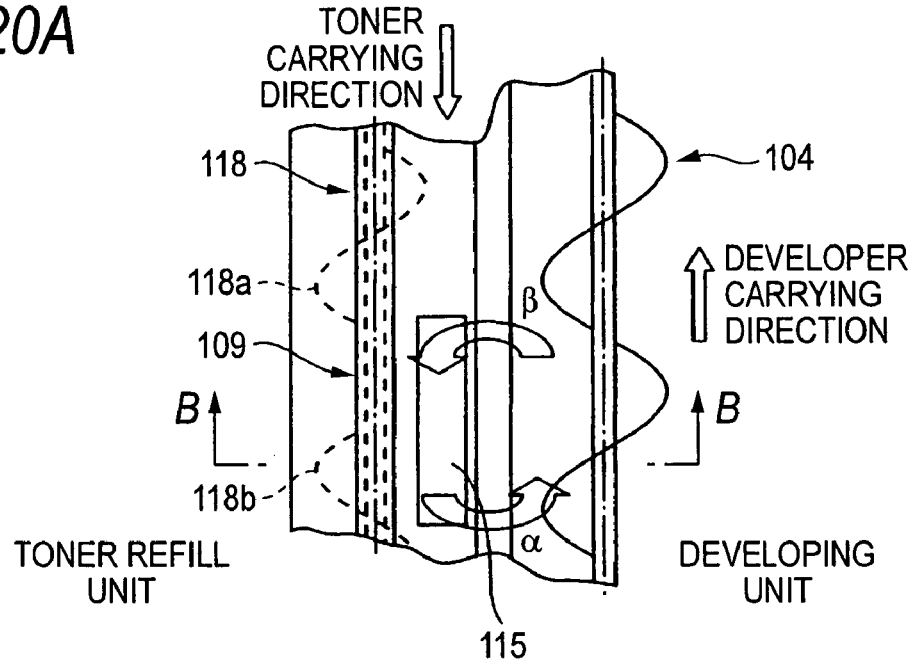
FIG. 20A is an explanatory view showing the peripheral structure of a toner supply port for the developing device according to an embodiment 6 of the invention.
Figure 20B:
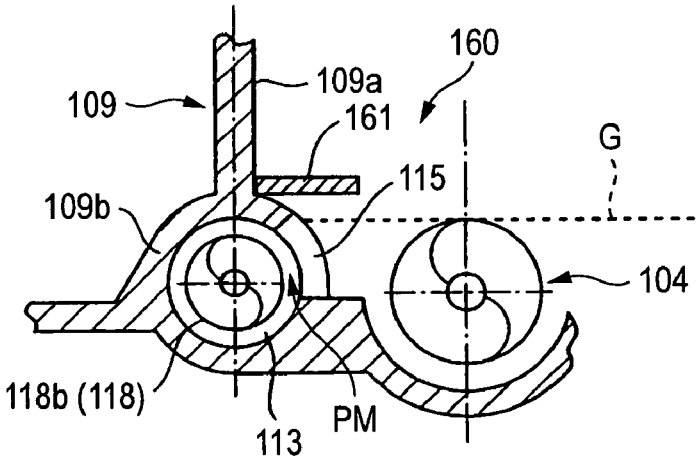
FIG. 20B is a cross-sectional view taken along the line B-B in FIG. 20A.

FIGS. 20A and 20B are explanatory views (corresponding to FIGS. 16A and 16B) showing the developing device according to an embodiment 6 of the invention.

In this embodiment, the basic constitution of the peripheral structure of the toner supply port is substantially the same as the embodiment 2, except that a toner behavior regulation guide 160 is provided on the side of the developer storage chamber 102 facing the toner supply port 115.

This toner behavior regulation guide 160 has a visor-like member 161 projecting almost horizontally from near an upper end of the thick wall portion 109*b* of the bulkhead 109 to the developer storage chamber 102. This visor-like member 161 is securely provided above the toner supply port 115, and the toner supply port 115 is disposed within a projection area of this visor-like member 161 from the above. The shape of this visor-like member 161 is not necessarily rectangular, but may be appropriately selected, for example, the shape of projection end is curved.

Also, in this embodiment, the toner behavior regulation guide 160 is located near the surface position of the developer G in the developer storage chamber 102, specifically, slightly above the surface position of the developer G at the maximum storage.

Accordingly, the refill toner T within the dispenser chamber 113 is transversely pushed out of the toner supply port 115 into the developer G of the developer storage chamber 102 due to an action of the preliminary mixing portion PM (auger vane 118*b* for stem) of the dispensing auger 118 in this embodiment, whereby there is a risk that the refill toner T is passed through the developer G and exposed on the surface of the developer G, if the pressing force of the preliminary mixing portion PM is strong. However, since the toner behavior regulation guide 160 is disposed to cover the top of the toner supply port 115 in this embodiment, the toner T exposed on the surface of the developer G collides with the toner behavior regulation guide 160, and is immediately returned to the developer G, whereby there is less possibility that the refill toner T is carried in a floating state on the surface of the developer G. Therefore, the refill toner T is efficiently agitated and mixed with the existent developer G within the developer storage chamber 102 by the admixing auger 104.

Particularly, the stationary toner behavior regulation guide 160 (the visor-like member 161 in this embodiment) for use in this embodiment is effective when the surface position of the developer G within the developer storage chamber 102 is slightly varied. As the toner behavior regulation guide 160 is closer to the surface position of the developer G, the regulation effect of the toner behavior is greatly exhibited.

Figure 20C:
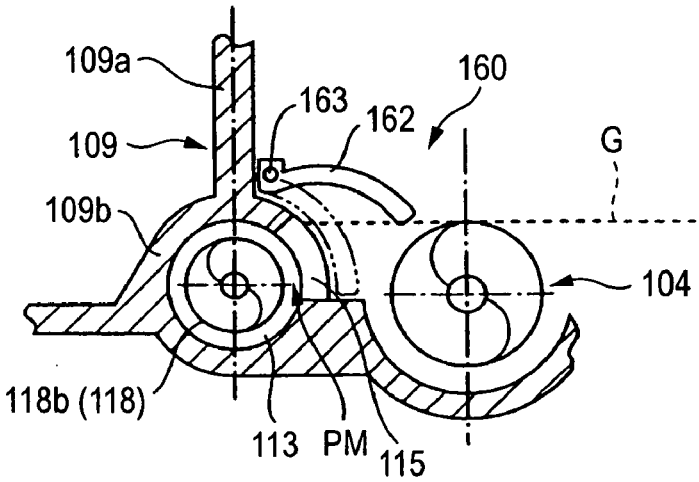
FIG. 20C is an explanatory view showing a modified form of a toner behavior regulation guide.

Also, the toner behavior regulation guide 160 is not limited to the above form, but may be constituted as shown in FIG. 20C.

In FIG. 20C, the toner behavior regulation guide 160 has a rotation shaft 163 near the upper end of the thick wall portion 101*b* of the bulkhead 109, and a cover 162 that can be opened or closed to cover the toner supply port 115 from the above conforming to the shape thereof. This cover 162 freely swingably opens and closes the rotation shaft 163 as a swing center. A swingable free end of this cover 162 is laid on the developer G in the developer storage chamber 102.

The operation of the toner behavior regulation guide 160 as shown in FIG. 20C will be described below.

First of all, in the case where the toner behavior regulation guide 160 is not provided, the surface position of the developer G in the developer storage chamber 102 rises or falls according to the toner consumption. At this time, the refill toner T pushed through the toner supply port 115 is circumferentially smeared with the developer G by preliminary mixing, and heavier than the single toner. If the surface position of the developer G decreases, there is possibility that the toner floats on the surface in the flow of the developer G in the developer storage chamber 102. Moreover, even when the surface position of the developer G is sufficiently high, there is possibility that the refill toner T shows up on the surface of the developer G like a lava dome, if the pressing force of the refill toner T from the toner supply port 115 is strong.

However, in this embodiment, since the cover 162 that is the toner behavior regulation guide 160 rises or falls according to the amount of developer in the developer storage chamber 102, it is always placed above the plane of projection of the toner supply port 115, even if the surface position of the developer G is varied. Therefore, if the refill toner T refilled through the toner supply port 115 is exposed from the surface of the developer G in the developer storage chamber 102, the operation of exposing the refill toner T to the surface of the developer is suppressed by the cover 162, thereby surely avoiding a risk that the refill toner T floats on the surface of the developer G.

Therefore, the refill toner T is surely agitated and mixed with the existent developer G in the flow of the developer G carried by the admixing auger 104.

Embodiment 7

Figure 21:
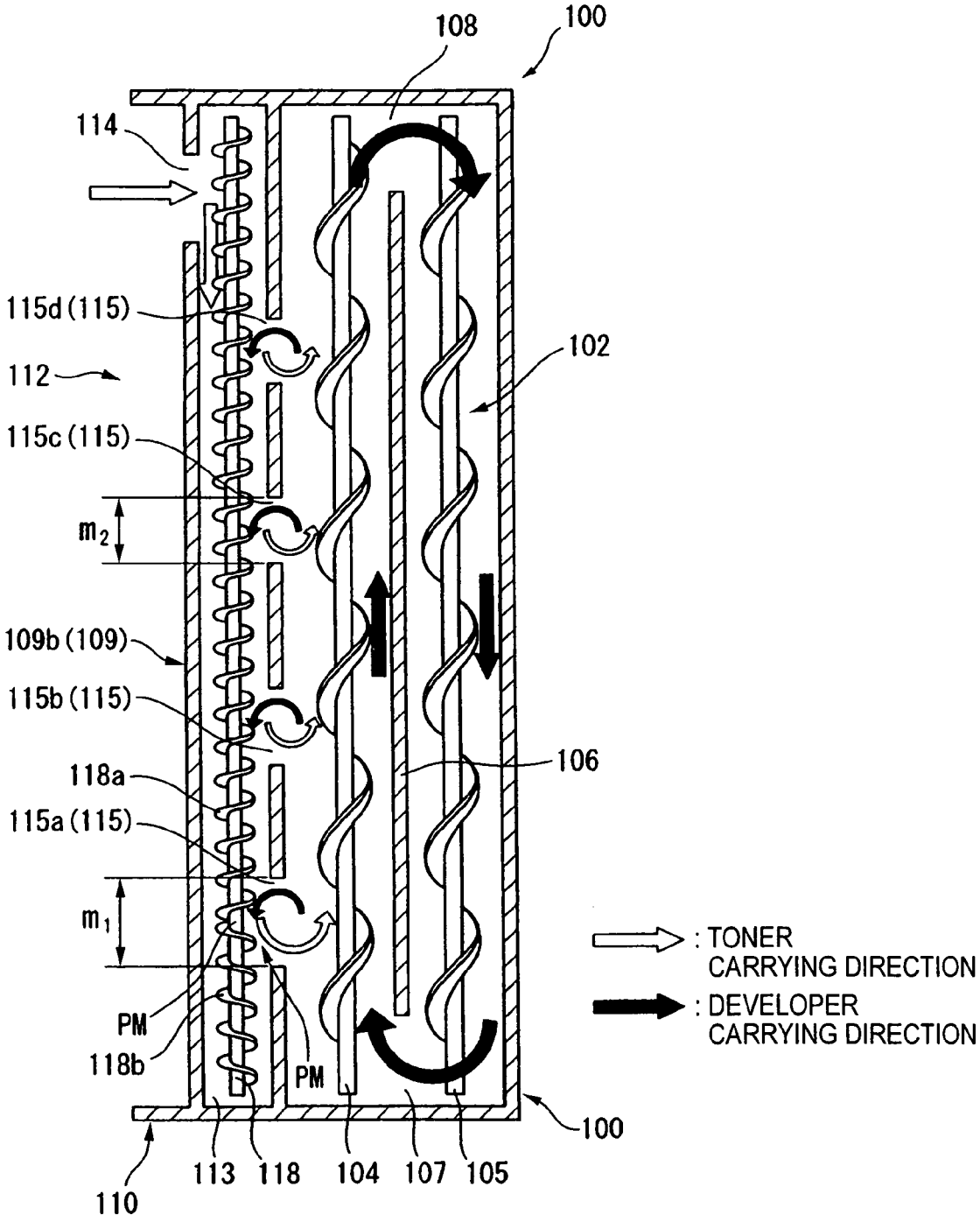
FIG. 21 is an explanatory view showing the essence of developing device according to an embodiment 7 of the invention.

FIG. 21 is a view showing the developing device according to an embodiment 7 of the invention.

In FIG. 21, the basic constitution of the developing device 33 is substantially the same as the embodiment 2, except that a plurality of toner supply ports 115 (115*a* to 115*d*) are opened in the portions facing the developer storage chamber 102 in the dispenser chamber 113 on the downstream side of the dispenser inlet port 114 in the longitudinal direction, in which each toner supply port 115 (115*a* to 115*d*) is opened so that its lower end is located below the surface position of the developer G stored in the developer storage chamber 102, and the toner behavior regulation guide (see the embodiment 6), not shown, is disposed on the side of the developer storage chamber 102 facing all or a part (e.g., the most downstream toner supply port 115*a*) of the toner supply ports 115, as needed.

Particularly, in this embodiment, each toner supply port 115 (115*a* to 115*d*) supplies the refill toner T to the developer storage chamber 102, and causes a part of the developer G within the developer storage chamber 102 to flow backward in a direction reverse to the refill toner supply direction.

Accordingly, according to this embodiment, the toner carrying direction in a portion facing each of the toner supply ports 115 (115*a* to 115*d*) within the dispenser chamber 113 and the developer carrying direction in a portion facing each of the toner supply ports 115 within the developer storage chamber 102 are reverse, causing a shearing force on the interface between the refill toner T and the developer G to generate a circulating flow of the toner T and the developer G as indicated. Therefore, the preliminary mixing is performed due to the circulating flow of the toner T and the developer G in the portions facing the toner supply ports 115 within the dispenser chamber 113 (preliminary mixing portions PM) to refill the toner through the toner supply ports 115. At this time, the behavior of the refill toner T is regulated by the toner behavior regulation guide, not shown, effectively avoiding a situation where the refill toner T floats on the surface of the developer in the developer storage chamber 102.

Also, in this embodiment, the most downstream toner supply port 115*a* (opening area m1) is preferably wider than the toner supply ports 115*b* to 115*d* (opening area m2) located on the upstream side. In this case, the preliminary mixing of the toner is more sufficiently made on the more downstream side in the toner carrying direction within the dispenser chamber 113, whereby it is effective that a greater refill amount of the toner is set to the most downstream toner supply port 115*a*.

Embodiment 8

Figure 22:
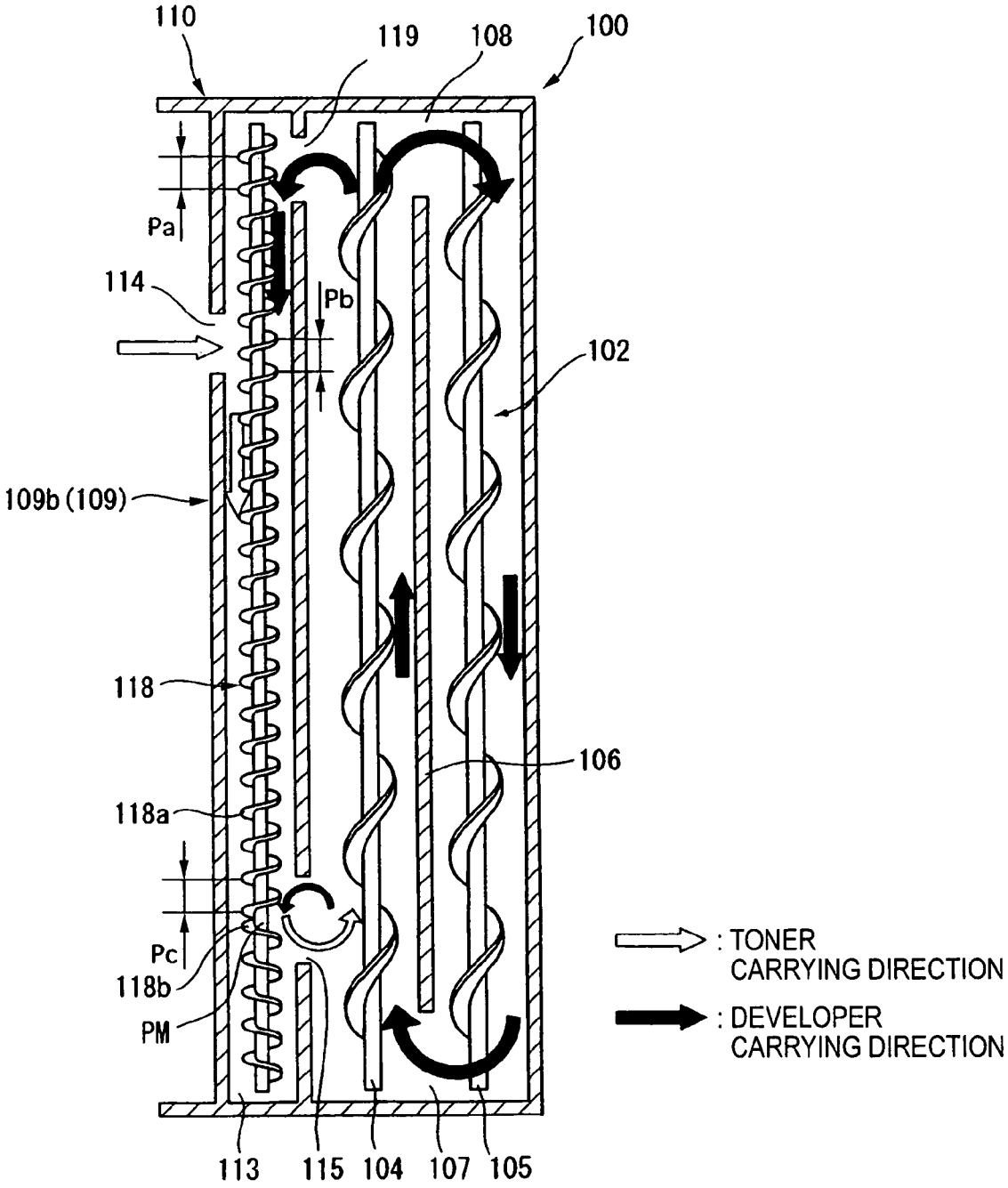
FIG. 22 is an explanatory view showing the essence of the developing device according to an embodiment 8 of the invention.

FIG. 22 is a view showing the essence of the developing device according to an embodiment 8 of the invention.

In FIG. 22, the basic constitution of the developing device 33 is substantially the same as the embodiment 2, except that the toner supply port 115 is opened in a portion facing the developer storage chamber 102 in the dispenser chamber 113 on the opposite side of the dispenser inlet port 114 in the longitudinal direction, and a developer receiving port 119 is opened in a portion facing the developer storage chamber 102 on the upstream side of the toner supply port 115 and the dispenser inlet port 114 in the toner carrying direction, in which the toner supply port 115 is opened so that its lower end is located below the surface position of the developer G stored in the developer storage chamber 102, and the toner behavior regulation guide (see the embodiment 6), not shown, is disposed on the side of the developer storage chamber 102 facing the toner supply port 115, as needed.

Accordingly, in this embodiment, if the developer G agitated and carried by the admixing auger 104 comes to the end portion of the circulation path on the side of the admixing auger 104, most of the developer G flows through the communication port 108 into the circulation path on the side of the supply auger 105, and a part of the developer G flows through the developer receiving port 119 into the dispenser chamber 113.

At this time, the received developer G is agitated and carried with the toner in a toner carrying process by the dispensing auger 118. Therefore, the refill toner T within the dispenser chamber 113 is preliminarily mixed with the received developer G, whereby a part of the refill toner within the dispenser chamber 113 reaching the portion facing the toner supply port 115 is sufficiently preliminarily mixed. As a result, the refill toner T refilled through the toner supply port 115 is preliminarily mixed in advance, and the refill toner T is further agitated and mixed with the existent developer G by the admixing auger 104 at the stage where it is supplied to the developer storage chamber 102.

In this way, the refill toner T is preliminarily mixed with a part of the developer G within the dispenser chamber 113, and then supplied to the developer storage chamber 102, whereby the agitating and mixing ability of the refill toner T is kept excellent. Since the behavior of the refill toner is regulated by the toner behavior regulation guide 160, there is no risk that the refill toner T floats on the surface of the developer.

Herein, in this embodiment, the toner supply port 115 may supply the refill toner from one way as in the embodiment 1, or supply the refill toner T to the developer storage chamber 102 and cause a part of the developer G in the developer storage chamber 102 to flow backward in a direction reverse to the refill toner supply direction as in the embodiment 2.

For example, if the toner supply port 115 takes the same structure as in the embodiment 2, the refill toner T within the dispenser chamber 113 is preliminarily mixed with the developer G received from the developer receiving port 119, and further preliminarily mixed near the toner supply port 115.

Particularly, in this embodiment, it is preferable that the auger pitch of the dispensing auger 118 disposed within the dispenser chamber 113 is set in the following way.

That is, supposing that the pitch of the dispensing auger in a portion opposed to the developer receiving port 119 is Pa, the pitch in a portion opposed to the dispenser inlet port 114 is Pb, and the pitch in a portion opposed to the toner supply port 115 is Pc, it is required that a relationship $Pa<Pb<Pc$ is satisfied.

In this form, a space is produced with the greater auger pitch in the portion (pitch Pb) of the dispensing auger 118 corresponding to the dispenser inlet port 114, whereby the toner is taken in through the dispenser inlet port 114 more effectively.

Also, in this form, a space is produced with the greater auger pitch, if the auger pitch is further widened in the portion (pitch Pc) of the dispensing auger 118 corresponding to the toner supply port 115 (Pc>Pb), whereby the developer G is taken in from the toner supply port 115 more effectively, as in the embodiment 4, and the preliminary mixing ability is kept excellent.

In this form, the length size of the opening portions 119, 114 and 115 along the axial direction of the dispensing auger 18 is appropriately determined depending on the receiving amount and the number of rotations of the dispensing auger 118, and about 0.1 to five times the relevant pitch.

Embodiment 9

Figure 23:
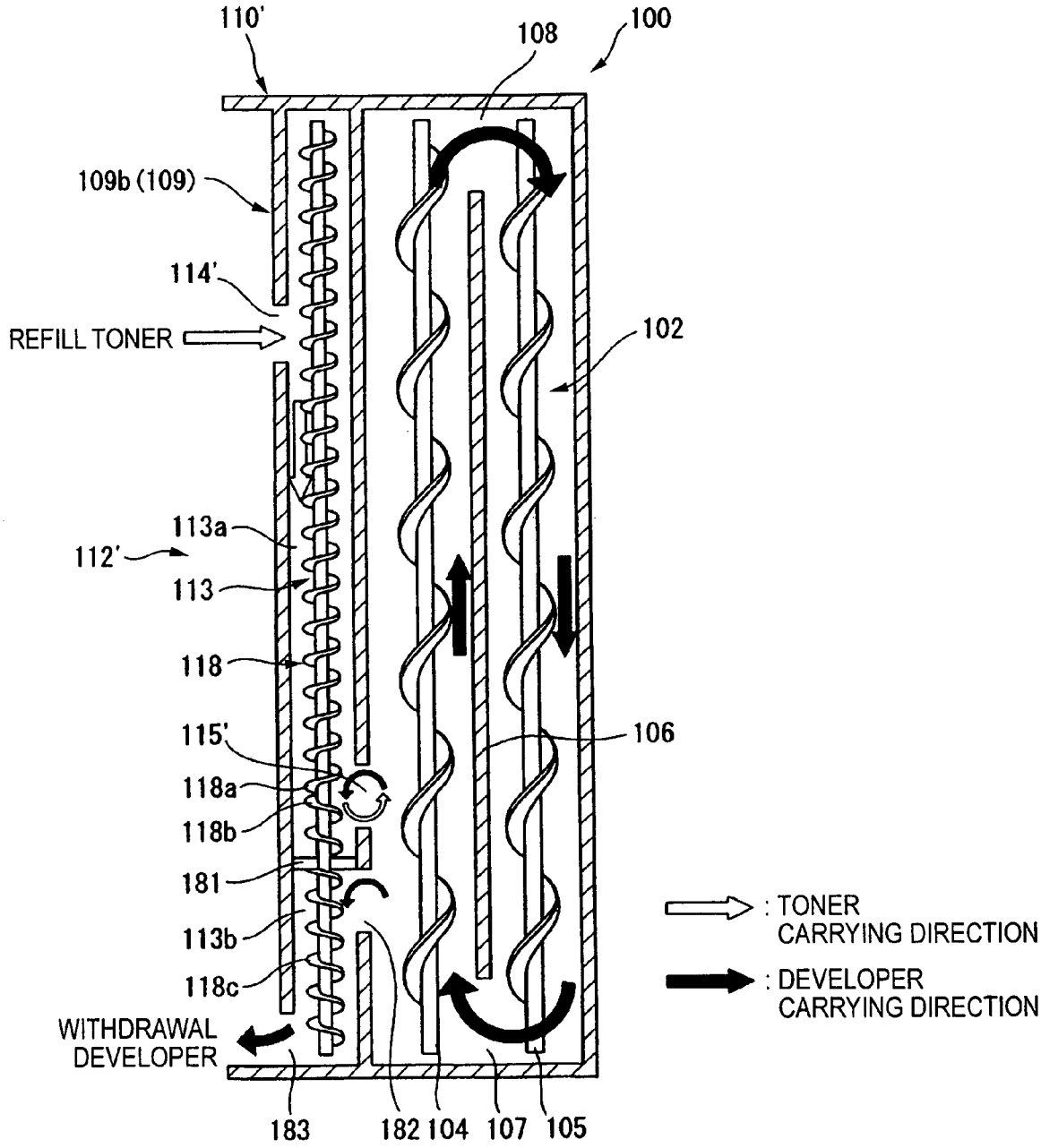
FIG. 23 is an explanatory view showing the essence of the developing device according to the embodiment 8 of the invention.
Figure 24:
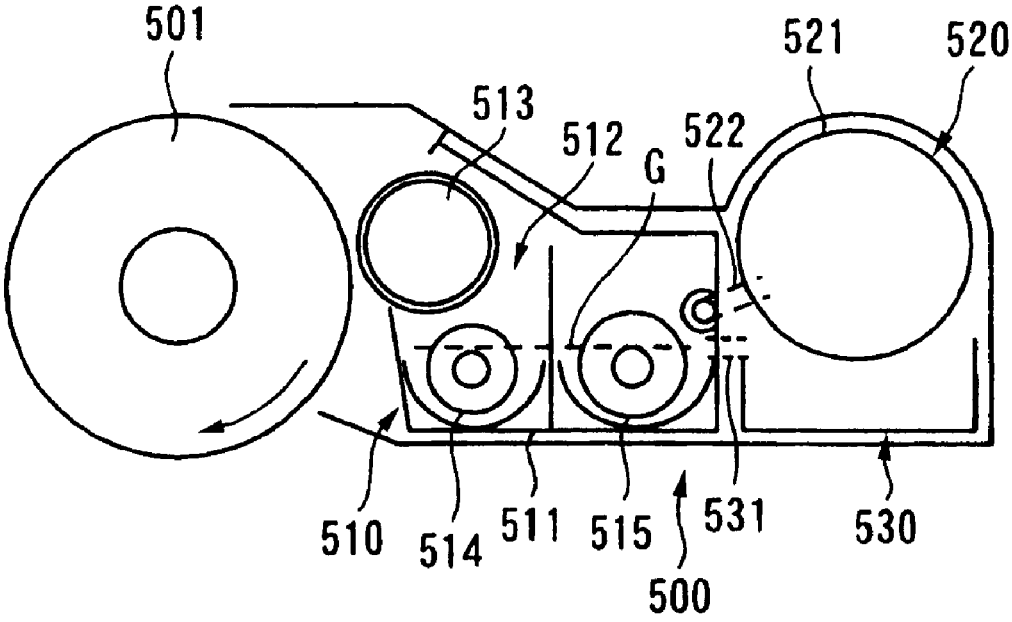
FIG. 24 PRIOR ART
FIG. 24 is an explanatory view showing one example of the conventional developing device.
Figure 25A:
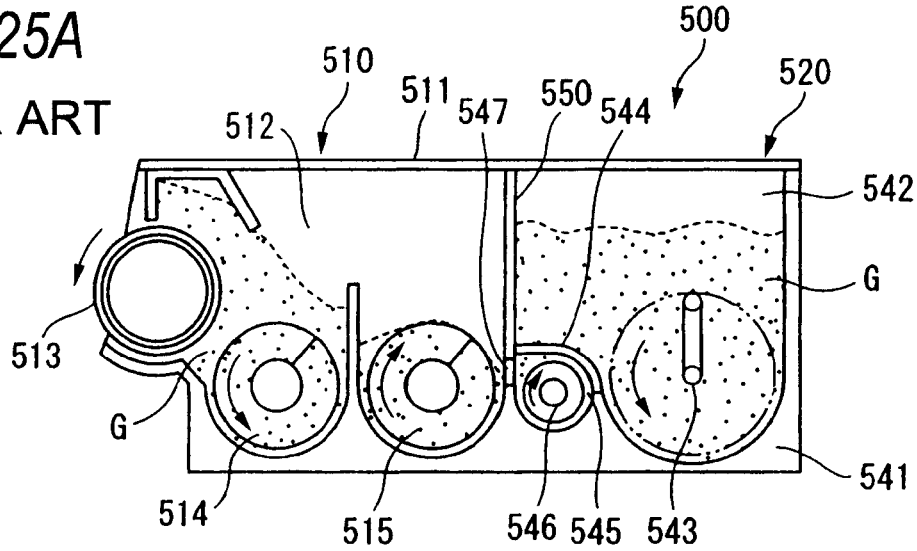
FIG. 25A PRIOR ART
FIG. 25A is an explanatory view showing another example of the conventional developing device.
Figure 25B:
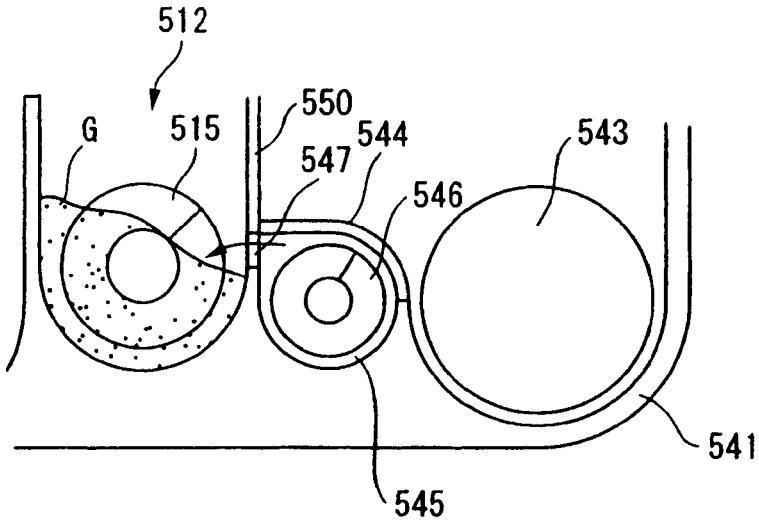
FIG. 25B PRIOR ART
FIG. 25B is an explanatory view showing a developer refill mechanism thereof.
Figure 25C:
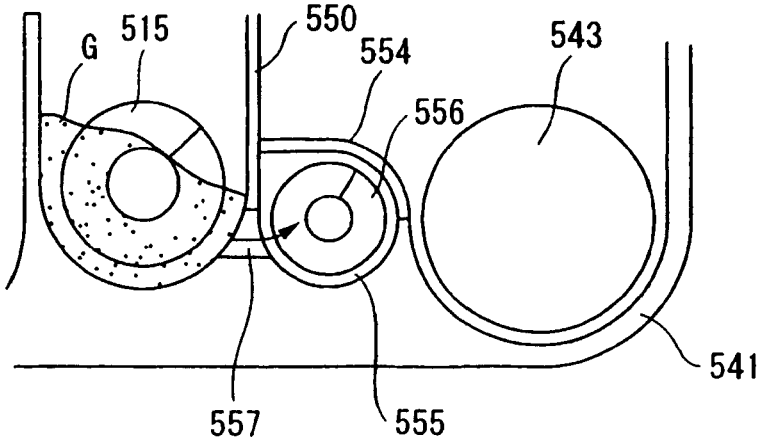
FIG. 25C PRIOR ART
FIG. 25C is an explanatory view showing a developer withdrawal mechanism thereof.

FIG. 23 is a view showing the developing device according to an embodiment 9 of the invention.

In FIG. 23, the basic constitution of the developing device 33, unlike the embodiments 1 to 8, has a developer refill withdrawal units 110' (comprising an auxiliary storage chamber 112' storing the developer composed of the toner and the carrier) disposed adjacent to the developing unit 100. Inside the bulkhead 109 for partitioning the developer storage chamber 102 and the auxiliary storage chamber 112', a dispense mechanism for refilling the developer and a dispense mechanism for withdrawing the waste developer are contained. The same or like parts are designated by the same signs as in the embodiment 1, and are not described in detail here.

In this embodiment, the bulkhead 109 has the thick wall portion 109*b* on the bottom of the thin wall portion, not shown (see FIG. 5), the thick wall portion 109*b* being internally provided with the tunnel-like dispenser chamber 113, in which the dispensing auger 118 is disposed in this dispenser chamber 113.

This dispenser chamber 113 is divided into two chambers 113*a* and 113*b* by a partition wall 181. In this embodiment, one dispenser chamber 113*a* has a sufficiently greater dispenser length than the other dispenser chamber 113*b*. The dispensing auger 118 is disposed in a state of penetrating through the partition wall 181.

The dispense mechanism for refilling the developer employs one dispenser chamber 113*a*, which is provided with a dispenser inlet port 114' in communication to the auxiliary storage chamber 112' on the upstream side in the carrying direction of the dispensing auger 118, and a developer supply port 115' opened in communication to the developer storage chamber 102 on the downstream side in the carrying direction of the dispensing auger 118. In this embodiment, the stem auger 118*b* is provided in a portion facing the developer supply port 115' in the dispensing auger 118 to secure the supply of the developer from the developer supply port 115'. Also, the developer supply port 115' is opened so that its lower end is located below the surface position of the developer stored in the developer storage chamber 102.

Also, the dispense mechanism for withdrawing the waste developer employs the other dispenser chamber 113*b*, which is provided with a developer withdrawal port 182 in communication to the developer storage chamber 102 on the upstream side in the carrying direction of the dispensing auger 118, and a developer return port 183 opened in communication to the auxiliary storage chamber 112' on the downstream side in the carrying direction of the dispensing auger 118.

Accordingly, in this embodiment, the dispense mechanism for refilling the developer takes in a new developer from the dispenser inlet port 114' along with the consumption of the toner, and refills the new developer via the dispenser chamber 113*a* from the developer supply port 115' to the developer storage chamber 102.

On the other hand, the dispense mechanism for withdrawing the waste developer takes in the waste developer from the dispense withdrawal opening 182 as the developer is deteriorated, and returns the waste developer via the dispenser chamber 113*a* from the developer return port 183 to the auxiliary storage chamber 112'.

At this time, if the dispenser inlet port 114' and the developer return port 183 are sufficiently separated, there is less risk that the partial waste developer and most of the new developer are unnecessarily mixed.

Also, in this embodiment, since the dispense mechanism for refilling the developer and the dispense mechanism for withdrawing the waste developer are provided inside the bulkhead 109, the space in the developer storage chamber 102 of the developing unit 100 or the auxiliary storage chamber 112' of the developer refill withdrawal unit 110' is not unnecessarily invaded due to existence of each dispenser mechanism, and no local concave or convex portion is provided on the outer side face of the thick wall portion 109*b* of the bulkhead 109. Thereby, there is no risk that the developer carrying ability is hampered.

[FIG. 1]

1 Developing unit
2 Developer storage chamber
3 Developer agitating carrying member
4 Developer holding member
5 Auxiliary developing unit
6 Auxiliary storage chamber
7 Bulkhead
8 Dispenser chamber
8*a*, 8*b* Communication port
9 Dispenser member
10 Developer carrying member
15 Image carrier
16 Developing device
G developer
2*a* Partition wall
2*b*, 2*c* Communication ports

What is claimed is:

1. A developing device comprising:

a developing unit having a developer storage chamber for storing a developer composed of a toner and a carrier, in which a developer agitating carrying member and a developer holding member capable of holding and carrying the developer agitated and carried by the developer agitating carrying member are disposed in the developer storage chamber; and an auxiliary developing unit for supplementing development for the developing unit, the auxiliary developing unit connected in communication with the developing unit and having an auxiliary storage chamber for storing the developer containing at least one of the toner and the carrier, wherein:

the developer storage chamber of the developing unit and the auxiliary storage chamber of the auxiliary developing unit are disposed adjacently via a bulkhead;

a dispenser chamber that can supply or withdraw a fixed amount of developer is formed in communication with the developer storage chamber and the auxiliary storage chamber inside the bulkhead; and a dispenser member for carrying a fixed amount of developer is disposed within the dispenser chamber;

wherein the bulkhead includes a thin wall portion for partitioning the developer storage chamber and the auxiliary storage chamber, and a thick wall portion; wherein the dispenser chamber is formed within the thick wall portion; and wherein the dispenser member is provided directly below the thin wall portion.

2. The developing device according to claim 1, wherein the auxiliary developing unit stores beforehand a new developer containing at least one of the toner and the carrier in the auxiliary storage chamber and supplies a fixed amount of developer in the auxiliary storage chamber through the dispenser chamber.

3. developing device according to claim 1, wherein the auxiliary developing unit withdraws a fixed amount of used developer from the developer storage chamber through the dispenser chamber, and stores the used developer in the auxiliary storage chamber.

4. The developing device according to claim 1, wherein a communication port between the dispenser chamber and the developer storage chamber is opened so that its lower end may be located below a surface position of the developer stored within the developer storage chamber.

5. The developing device according to claim 1, wherein the dispenser chamber is provided along a longitudinal direction of the bulkhead.

6. The developing device according to claim 5, wherein the dispenser chamber is provided over the almost entire area in the longitudinal direction of the bulkhead.

7. The developing device according to claim 1, wherein the dispenser chamber has a communication port to the auxiliary storage chamber and a communication port to the developer storage chamber which are spaced apart.

8. The developing device according to claim 1, wherein the thin wall portion of the bulkhead is provided around an axially central position of the dispenser member within the dispenser chamber.

9. The developing device according to claim 1, wherein the dispenser chamber is provided at a lower portion of the bulkhead.

10. The developing device according to claim 1, wherein the auxiliary developing unit has a developer carrying member in the auxiliary storage chamber, in which the central position of the developer carrying member is located above the position of the communication port between the auxiliary storage chamber and the dispenser chamber.

11. The developing device according to claim 1, wherein the auxiliary developing unit has a developer carrying member in the auxiliary storage chamber, in which a part of the bulkhead on the side of the auxiliary storage chamber on a wall outside face surrounding the dispenser chamber is formed along a rotation locus of the developer carrying member.

12. The developing device according to claim 1, wherein a toner refill unit has a part of the bulkhead on the side of the developer storage chamber on a wall outside face surrounding the dispenser chamber which is formed along a rotation locus of the developer agitating carrying member.

13. The developing device according to claim 1, wherein each of the communication ports to the dispenser chamber is covered with a seal member that is closed openably when in use.

14. A process cartridge removably mounted on a main body of an image forming apparatus, comprising:

an image carrier; and a developing device including: a developing unit having a developer storage chamber for storing a developer composed of a toner and a carrier, in which a developer agitating carrying member and a developer holding member capable of holding and carrying the developer agitated and carried by the developer agitating carrying member are disposed in the developer storage chamber; and an auxiliary developing unit for supplementing development for the developing unit, the auxiliary developing unit connected in communication with the developing unit and having an auxiliary storage chamber for storing the developer containing at least one of the toner and the carrier, wherein:

the developer storage chamber of the developing unit and the auxiliary storage chamber of the auxiliary developing unit are disposed adjacently via a bulkhead;

a dispenser chamber that can supply or withdraw a fixed amount of developer is formed in communication with the developer storage chamber and the auxiliary storage chamber inside the bulkhead;

a dispenser member for carrying a fixed amount of developer is disposed within the dispenser chamber; and the developing device is opposed to the image carrier;

wherein the bulkhead includes a thin wall port ion for partitioning the developer storage chamber and the auxiliary storage chamber, and a thick wall portion; wherein the dispenser chamber is formed within the thick wall portion; and wherein the dispenser member is provided directly below the thin wall portion.

15. An image forming apparatus comprising:

a main body; and a process cartridge removably mounted on the main body of the image forming apparatus, including: an image carrier; and a developing device having: a developing unit having a developer storage chamber for storing a developer composed of a toner and a carrier, in which a developer agitating carrying member and a developer holding member capable of holding and carrying the developer agitated and carried by the developer agitating carrying member are disposed in the developer storage chamber; and an auxiliary developing unit for supplementing development for the developing unit, the auxiliary developing unit connected in communication with the developing unit and having an auxiliary storage chamber for storing the developer containing at least one of the toner and the carrier, wherein:

the developer storage chamber of the developing unit and the auxiliary storage chamber of the auxiliary developing unit are disposed adjacently via a bulkhead;

a dispenser chamber that can supply or withdraw a fixed amount of developer is formed in communication with the developer storage chamber and the auxiliary storage chamber inside the bulkhead;

a dispenser member for carrying a fixed amount of developer is disposed within the dispenser chamber; and the developing device is opposed to the image carrier;

wherein the bulkhead includes a thin wall portion for partitioning the developer storage chamber and the auxiliary storage chamber, and a thick wall portion; wherein the dispenser chamber is formed within the thick wall portion; and wherein the dispenser member is provided directly below the thin wall portion.

16. An image forming apparatus comprising:

an image carrier; and a developing device including: a developing unit having a developer storage chamber for storing a developer composed of a toner and a carrier, in which a developer agitating carrying member and a developer holding member capable of holding and carrying the developer agitated and carried by the developer agitating carrying member are disposed in the developer storage chamber; and an auxiliary developing unit for supplementing development for the developing unit, the auxiliary developing unit connected in communication with the developing unit and having an auxiliary storage chamber for storing the developer containing at least one of the toner and the carrier, wherein:

the developer storage chamber of the developing unit and the auxiliary storage chamber of the auxiliary developing unit are disposed adjacently via a bulkhead;

a dispenser chamber that can supply or withdraw a fixed amount of developer is formed in communication with the developer storage chamber and the auxiliary storage chamber inside the bulkhead;

a dispenser member for carrying a fixed amount of developer is disposed within the dispenser chamber; and the developing device is opposed to the image carrier;

wherein the bulkhead includes a thin wall portion for partitioning the developer storage chamber and the auxiliary storage chamber, and a thick wall portion; wherein the dispenser chamber is formed within the thick wall portion; and wherein the dispenser member is provided directly below the thin wall portion.

* * * * *